US011273633B2

(12) United States Patent
Hagiwara et al.

(10) Patent No.: US 11,273,633 B2
(45) Date of Patent: Mar. 15, 2022

(54) LIQUID DISCHARGE APPARATUS

(71) Applicant: SEIKO EPSON CORPORATION, Tokyo (JP)

(72) Inventors: Hiroyuki Hagiwara, Matsumoto (JP); Nobuaki Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 17 days.

(21) Appl. No.: 17/036,245

(22) Filed: Sep. 29, 2020

(65) Prior Publication Data

US 2021/0094277 A1 Apr. 1, 2021

(30) Foreign Application Priority Data

Sep. 30, 2019 (JP) ..... JP2019-178220

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
CPC ..... B41J 2/04505; B41J 2/04586
See application file for complete search history.

(56) References Cited

U.S. PATENT DOCUMENTS 6,557,976 B2 * 5/2003 McElfresh ..... B41J 2/14072 347/40
2018/0104947 A1 * 4/2018 Poulikakos ..... B41J 2/04505

FOREIGN PATENT DOCUMENTS

JP 2017-136720 A 8/2017

* cited by examiner

*Primary Examiner* — Thinh H Nguyen
(74) *Attorney, Agent, or Firm* — Workman Nydegger

(57) ABSTRACT

The control section outputs a first output value as an output value which corresponds to the first nozzle group when a first input value is input as an input value which corresponds to the first nozzle group, and outputs a second output value as an output value which corresponds to the second nozzle group when the first input value is input as an input value which corresponds to the second nozzle group, the second output value being larger than the first output value.

18 Claims, 13 Drawing Sheets

| | | POST-CORRECTION DATA Sout2 | |
|---|---|---|---|
| | | GN1 | GN2, GN3 |
| PRE-CORRECTION DATA Sin2 | 64 | 82 | 128 |
| | 128 | 160 | 208 |
| | 192 | 224 | 240 |
| | 255 | 255 | 255 |

DITHER MATRIX GN1

| | | | |
|---|---|---|---|
| 48 | 255 | 96 | 176 |
| 208 | 144 | 32 | 240 |
| 80 | 112 | 192 | 128 |
| 16 | 224 | 160 | 64 |

DITHER MATRIX GN2, GN3

| | | | |
|---|---|---|---|
| 30 | 255 | 63 | 118 |
| 160 | 96 | 19 | 224 |
| 52 | 74 | 128 | 85 |
| 8 | 192 | 107 | 41 |

Sin3 = 64
Sout3 = 4/16

Sin3 = 64
Sout3 = 8/16

Sin3 = 128
Sout3 = 8/16

Sin3 = 128
Sout3 = 11/16

Sin3 = 192
Sout3 = 12/16

Sin3 = 192
Sout3 = 14/16

Sin3 = 255
Sout3 = 16/16

Sin3 = 255
Sout3 = 16/16

FIG. 18

| FIRST COLOR SPACE DATA Sin1 | | | SECOND COLOR SPACE DATA Sout1 | | | | | |
|---|---|---|---|---|---|---|---|---|
| | | | GN1 | | | GN2, GN3 | | |
| R | G | B | C | M | Y | C | M | Y |
| 0 | 0 | 0 | 255 | 255 | 255 | 255 | 255 | 255 |
| 1 | 0 | 1 | 254 | 255 | 254 | 254 | 255 | 254 |
| ⋮ | ⋮ | ⋮ | ⋮ | ⋮ | ⋮ | ⋮ | ⋮ | ⋮ |
| 126 | 0 | 126 | 128 | 255 | 128 | 193 | 255 | 193 |
| 127 | 0 | 127 | 127 | 255 | 127 | 192 | 255 | 192 |
| 128 | 0 | 128 | 126 | 255 | 126 | 191 | 255 | 191 |
| ⋮ | ⋮ | ⋮ | ⋮ | ⋮ | ⋮ | ⋮ | ⋮ | ⋮ |
| 254 | 0 | 254 | 1 | 255 | 1 | 2 | 255 | 2 |
| 255 | 0 | 255 | 0 | 255 | 0 | 0 | 255 | 0 |

LIQUID DISCHARGE APPARATUS

The present application is based on, and claims priority from JP Application Serial Number 2019-178220, filed Sep. 30, 2019, the disclosure of which is hereby incorporated by reference here in its entirety.

BACKGROUND

1. Technical Field

The present disclosure relates to a liquid discharge apparatus.

2. Related Art

In the related art, a liquid discharge apparatus that discharges a liquid such as ink as droplets is known, as represented by an ink jet printer. For example, JP-A-2017-136720 describes a liquid ejecting apparatus including a liquid ejecting unit having a first portion, a second portion, and a third portion. In the liquid ejecting unit, the first portion is positioned between the second portion and the third portion, and the widths of the second portion and the third portion are smaller than the width of the first portion. A plurality of nozzles are provided over the first portion, the second portion, and the third portion.

In the liquid ejecting unit of JP-A-2017-136720, since the width of the second portion is smaller than the width of the first portion, the heat capacity of the second portion is smaller than that of the first portion, and therefore, the second portion dissipates heat more easily than the first portion. Therefore, the liquid flowing through the second portion tends to have a temperature lower than that of the liquid flowing through the first portion. Here, a discharge amount of the liquid from the liquid ejecting unit decreases due to an influence of an increase in a viscosity of the liquid as the temperature decreases. In the related art, since no consideration has been given to a temperature difference between the first portion and the second portion, the temperature difference appears as a difference in the liquid discharge amount between the first portion and the second portion, and as a result, there is a problem that the image quality is deteriorated.

SUMMARY

According to an aspect of the present disclosure, there is provided a liquid discharge apparatus including: a head unit in which a plurality of nozzles that discharge liquid are provided; and a control section that controls a discharge operation of the liquid in the head unit, in which the head unit has a first portion, and a second portion which is different from the first portion in position in a first direction, and which has a width smaller than a width of the first portion in a second direction intersecting the first direction, the plurality of nozzles include a first nozzle group provided in the first portion, and a second nozzle group provided in the second portion, and the control section outputs a first output value as an output value which corresponds to the first nozzle group when a first input value is input as an input value which corresponds to the first nozzle group, and outputs a second output value as an output value which corresponds to the second nozzle group when the first input value is input as an input value which corresponds to the second nozzle group, the second output value being larger than the first output value.

BRIEF DESCRIPTION OF THE DRAWINGS

FIG. 18 is a table illustrating an example of a relationship between a value of first color space information and a value of second color space information.

DESCRIPTION OF EXEMPLARY EMBODIMENTS

Figure 2:
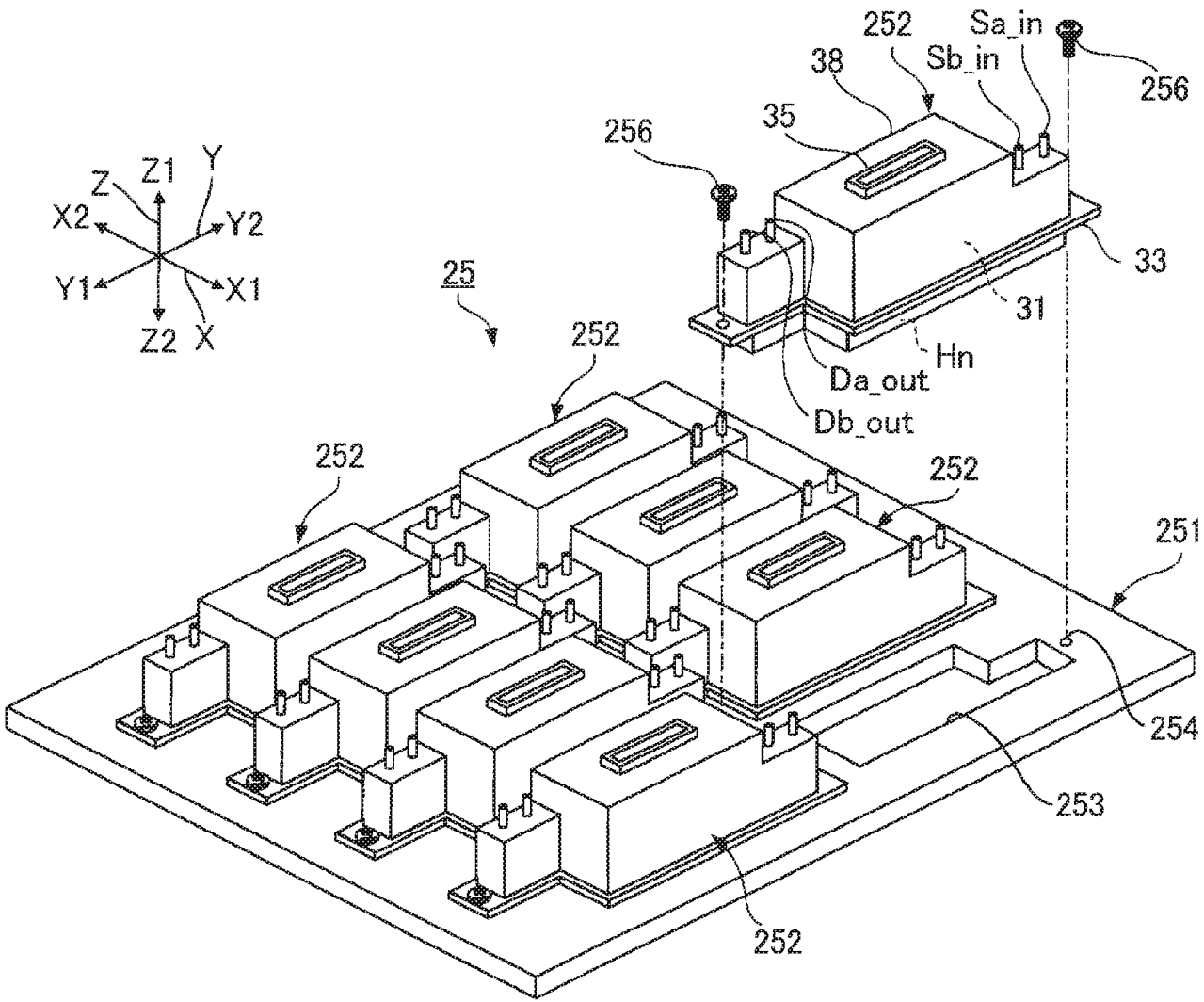
FIG. 2 is a perspective diagram of a head module.

In the following description, an X axis, a Y axis, and a Z axis that are orthogonal to each other are assumed. As illustrated in FIG. 2, one direction along the X axis when viewed from an optional point is referred to as an X1 direction, and a direction opposite to the X1 direction is referred to as an X2 direction. Similarly, directions opposite to each other along the Y axis from an optional point are referred to as a Y1 direction and a Y2 direction, and directions opposite to each other along the Z axis from an optional point are referred to as a Z1 direction and a Z2 direction. An X-Y plane including the X axis and the Y axis corresponds to a horizontal plane. The Z axis is an axis along a vertical direction, and the Z2 direction corresponds to a lower side in the vertical direction. The X axis, the Y axis, and the Z axis may intersect with each other at an angle of substantially 90 degrees.

1. First Embodiment 1-1. Liquid Discharge Apparatus 100

Figure 1:
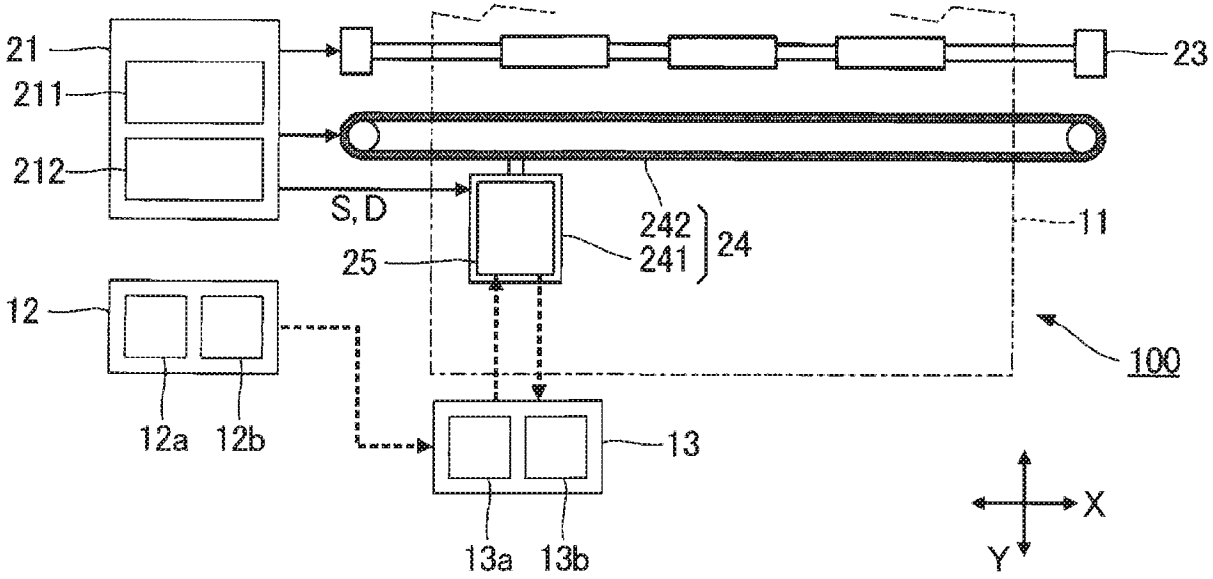
FIG. 1 is a schematic diagram exemplifying a configuration of a liquid discharge apparatus according to a first embodiment.

FIG. 1 is a schematic diagram illustrating a configuration of a liquid discharge apparatus 100 according to a first embodiment. The liquid discharge apparatus 100 is an ink jet printer that discharges ink, which is an example of a liquid, as droplets onto a medium 11. The medium 11 is typically printing paper. However, a print target made of any material such as a resin film or cloth may be used as the medium 11.

As exemplified in FIG. 1, the liquid discharge apparatus 100 is provided with a liquid container 12 that stores ink. For example, a cartridge that is attachable to and detachable from the liquid discharge apparatus 100, a bag-shaped ink pack formed of a flexible film, or an ink tank that can be replenished with ink is used as the liquid container 12. As exemplified in FIG. 1, the liquid container 12 includes a liquid container 12*a* and a liquid container 12*b*. First ink is stored in the liquid container 12*a*, and second ink is stored in the liquid container 12*b*. The first ink and the second ink are different types of ink. For example, the first ink and the second ink are two inks selected from cyan ink, magenta ink, yellow ink, and black ink.

The liquid discharge apparatus 100 is provided with a sub tank 13 that temporarily stores ink. Ink supplied from the liquid container 12 is stored in the sub tank 13. The sub tank 13 includes a sub tank 13*a* that stores the first ink and a sub tank 13*b* that stores the second ink. The sub tank 13*a* is coupled to the liquid container 12*a*, and the sub tank 13*b* is coupled to the liquid container 12*b*. Further, the sub tank 13 is coupled to a head module 25, supplies ink to the head module 25, and collects ink from the head module 25. The ink flow between the sub tank 13 and the head module 25 will be described in detail later.

As illustrated in FIG. 1, the liquid discharge apparatus 100 includes a control unit 21, a transport mechanism 23, a moving mechanism 24, and a head module 25. The control unit 21 controls each element of the liquid discharge apparatus 100. The control unit 21 has a control section 211 and a pulse generation section 212. The control section 211 generates a control signal S for controlling an ink discharge operation of the head module 25, and a signal that includes an output value Sout that defines a waveform generated in the pulse generation section 212 based on a signal that includes an input value Sin. The control section 211 includes, for example, one or more processing circuits such as a central processing unit (CPU) and a field programmable gate array (FPGA) and one or more storage circuits such as a semiconductor memory. The pulse generation section 212 is a circuit that generates a drive signal D for discharging ink from the head module 25 based on the output value Sout. The control section 211 and the drive signal D will be described in detail later.

The transport mechanism 23 transports the medium 11 along the Y axis under the control of the control unit 21. The moving mechanism 24 reciprocates the head module 25 along the X axis under the control of the control unit 21. The moving mechanism 24 of the present embodiment includes a substantially box-shaped transporting body 241 that accommodates the head module 25, and an endless belt 242 to which the transporting body 241 is fixed. A configuration in which the liquid container 12 and the sub tank 13 are mounted on the transporting body 241 together with the head module 25 can also be adopted.

The head module 25 discharges ink supplied from the sub tank 13 from each of a plurality of nozzles onto the medium 11 under the control of the control unit 21. An image is formed on the surface of the medium 11 by the head module 25 discharging ink onto the medium 11 in parallel with a transport of the medium 11 by the transport mechanism 23 and a repeated reciprocation of the transporting body 241.

FIG. 2 is a perspective diagram of the head module 25. As illustrated in FIG. 2, the head module 25 includes a support body 251 and a plurality of head units 252. The support body 251 is a plate-shaped member that supports the plurality of head units 252. A plurality of mounting holes 253 and a plurality of screw holes 254 are formed in the support body 251. Each head unit 252 is supported by the support body 251 while being inserted into the mounting hole 253. Two screw holes 254 are provided for each mounting hole 253. As illustrated in FIG. 2, each head unit 252 is fixed to the support body 251 by screwing using screws 256 and screw holes 254 at two positions. The plurality of head units 252 are arranged side by side along the X axis and the Y axis. However, the number of head units 252 and the arrangement of the plurality of head units 252 are not limited to the above examples.

1-2. Head Unit 252

Figure 3:
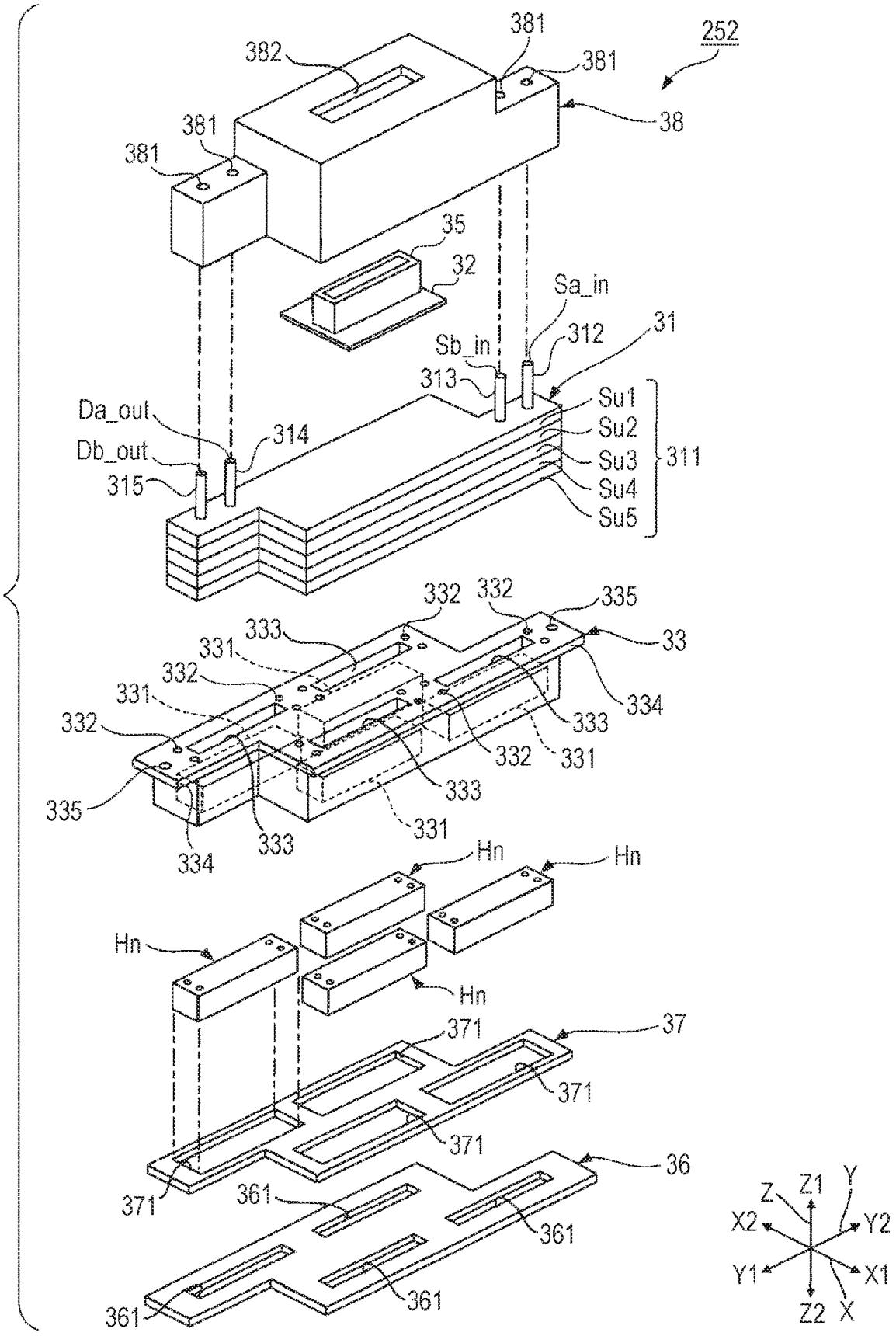
FIG. 3 is an exploded perspective diagram of a head unit.

FIG. 3 is an exploded perspective diagram of the head unit 252. As illustrated in FIG. 3, the head unit 252 includes a flow path member 31, a wiring substrate 32, a holder 33, a plurality of circulation heads Hn, a fixing plate 36, a reinforcing plate 37, and a cover 38. The flow path member 31 is positioned between the wiring substrate 32 and the holder 33. Specifically, the holder 33 is installed in the Z2 direction with respect to the flow path member 31, and the wiring substrate 32 is installed in the Z1 direction with respect to the flow path member 31. In the present embodiment, the number of circulation heads Hn provided in each head unit 252 is four. In the following, these four circulation heads Hn are also referred to as circulation heads H1, H2, H3, and H4.

The flow path member 31 is a structure in which a flow path for supplying the ink stored in the sub tank 13 to the plurality of circulation heads Hn is formed. The flow path member 31 includes a flow path structure 311 and coupling pipes 312, 313, 314, and 315. Although not illustrated in FIG. 3, the flow path structure 311 includes a supply flow path for supplying the first ink to the plurality of circulation heads Hn, a supply flow path for supplying the second ink to the plurality of circulation heads Hn, a discharge flow path for discharging the first ink from the plurality of circulation heads Hn, and a discharge flow path for discharging the second ink from the plurality of circulation heads Hn. The flow path structure 311 is formed by stacking a plurality of substrates Su1 to Su5. The plurality of substrates Su1 to Su5 forming the flow path structure 311 are formed by injection molding of a resin material, for example. The plurality of substrates Su1 to Su5 are bonded to each other with, for example, an adhesive. The flow path structure 311 described above has a longitudinal shape along the Y axis. The coupling pipes 312 and 313 are provided at a portion on one end side of the flow path structure 311 in the longitudinal direction, and the coupling pipes 314 and 315 are provided at a portion on the other end side of the flow path structure 311 in the longitudinal direction. Each of the coupling pipes 312, 313, 314, and 315 is a pipe body protruding from the flow path structure 311. The coupling pipe 312 is a supply pipe provided with a supply port Sa_in for supplying the first ink to the flow path structure 311. Similarly, the coupling pipe 313 is a supply pipe provided with a supply port Sb_in for supplying the second ink to the flow path structure 311. On the other hand, the coupling pipe 314 is a discharge pipe provided with a discharge port Da_out for discharging the first ink from the flow path structure 311. Similarly, the coupling pipe 315 is a discharge pipe provided with a discharge port Db_out for discharging the second ink from the flow path structure 311.

The wiring substrate 32 is a mounting component for electrically coupling the head unit 252 to the control unit 21. The wiring substrate 32 is configured by, for example, a flexible wiring substrate or a rigid wiring substrate. The wiring substrate 32 is disposed on the flow path member 31. One surface of the wiring substrate 32 faces the flow path member 31. A coupler 35 is installed on the other surface of the wiring substrate 32. The coupler 35 is a coupling component for electrically coupling the head unit 252 and the control unit 21. Further, although not illustrated, wirings coupled to the plurality of circulation heads Hn are coupled to the wiring substrate 32. The wiring is composed of, for example, a combination of a flexible wiring substrate and a rigid wiring substrate. The wiring may be integrated with the wiring substrate 32.

The holder 33 is a structure that accommodates and supports the plurality of circulation heads Hn. The holder 33 is made of, for example, a resin material or a metal material. The holder 33 is provided with a plurality of recesses 331, a plurality of ink holes 332, a plurality of wiring holes 333, and a pair of flanges 334. Each of the plurality of recesses 331 is a space that opens in the Z2 direction and in which the circulation head Hn is disposed. Each of the plurality of ink holes 332 is a flow path that allows ink to flow between the circulation head Hn disposed in the recess 331 and the flow path member 31. Each of the plurality of wiring holes 333 is a hole through which wiring (not illustrated) that couples the circulation head Hn to the wiring substrate 32 is passed. The pair of flanges 334 are fixing portions for fixing the holder 33 to the support body 251. The pair of flanges 334 illustrated in FIG. 3 are provided with holes 335 for screwing to the support body 251. The aforementioned screw 256 is passed through the hole 335.

Each circulation head Hn discharges ink. That is, although not illustrated in FIG. 3, each circulation head Hn has a plurality of nozzles for discharging the first ink and a plurality of nozzles for discharging the second ink. The configuration of the circulation head Hn will be described later.

The fixing plate 36 is a plate member for fixing the plurality of circulation heads Hn to the holder 33. Specifically, the fixing plate 36 is disposed so as to interpose the plurality of circulation heads Hn with the holder 33, and is fixed to the holder 33 with an adhesive. The fixing plate 36 is made of, for example, a metal material. The fixing plate 36 is provided with a plurality of openings 361 for exposing the nozzles of the plurality of circulation heads Hn. In the example of FIG. 3, the plurality of openings 361 are individually provided for each circulation head Hn. The opening 361 may be shared by two or more circulation heads Hn.

The reinforcing plate 37 is a plate-shaped member that is disposed between the holder 33 and the fixing plate 36 and reinforces the fixing plate 36. The reinforcing plate 37 is disposed on the fixing plate 36 in an overlapping manner and fixed to the fixing plate 36 with an adhesive. The reinforcing plate 37 is provided with a plurality of openings 371 in which the plurality of circulation heads Hn are disposed. The reinforcing plate 37 is made of, for example, a metal material. From the viewpoint of reinforcing the fixing plate 36, the thickness of the reinforcing plate 37 is preferably thicker than the thickness of the fixing plate 36.

The cover 38 is a box-shaped member that accommodates the flow path structure 311 of the flow path member 31 and the wiring substrate 32. The cover 38 is made of, for example, a resin material or the like. The cover 38 is provided with four through holes 381 and an opening 382. The four through holes 381 correspond to the four coupling pipes 312 of the flow path member 31, and the corresponding coupling pipes 312, 313, 314, and 315 are passed through the respective through holes 381. The coupler 35 is passed through the opening 382 from the inside of the cover 38 to the outside.

Figure 4:
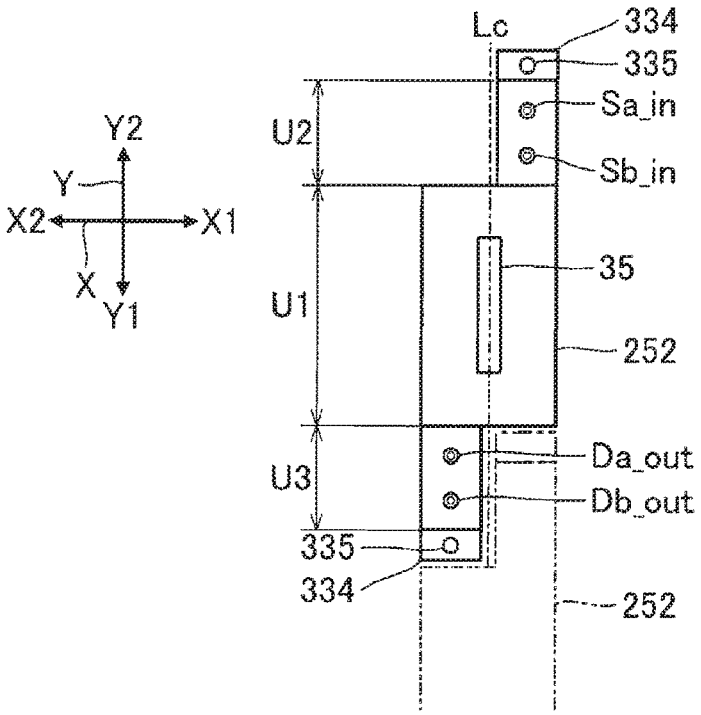
FIG. 4 is a plan diagram of a head unit as seen from a Z1 direction.

FIG. 4 is a plan diagram of the head unit 252 as seen from the Z1 direction. As illustrated in FIG. 4, each head unit 252 has an outer shape including a first portion U1, a second portion U2, and a third portion U3 when viewed from the Z1 direction. The first portion U1 is positioned between the second portion U2 and the third portion U3. Specifically, the second portion U2 is positioned in the Y2 direction with respect to the first portion U1, and the third portion U3 is positioned in the Y1 direction with respect to the first portion U1. In the present embodiment, each of the flow path member 31 and the holder 33 has an outer shape corresponding to the head unit 252 when viewed from the Z1 direction. The wiring substrate 32 has an outer shape corresponding to the first portion U1 when viewed from the Z1 direction.

FIG. 4 illustrates a center line Lc which is a line segment passing through the center of the first portion U1 along the Y axis. The second portion U2 is positioned in the X1 direction with respect to the center line Lc, and the third portion U3 is positioned in the X2 direction with respect to the center line Lc. That is, the second portion U2 and the third portion U3 are positioned on opposite sides of the X axis with the center line Lc interposed therebetween. As illustrated in FIG. 4, the plurality of head units 252 are arranged along the Y axis so that the third portion U3 of each head unit 252 and the second portion U2 of the other head unit 252 partially overlap along the Y axis.

Figure 5:
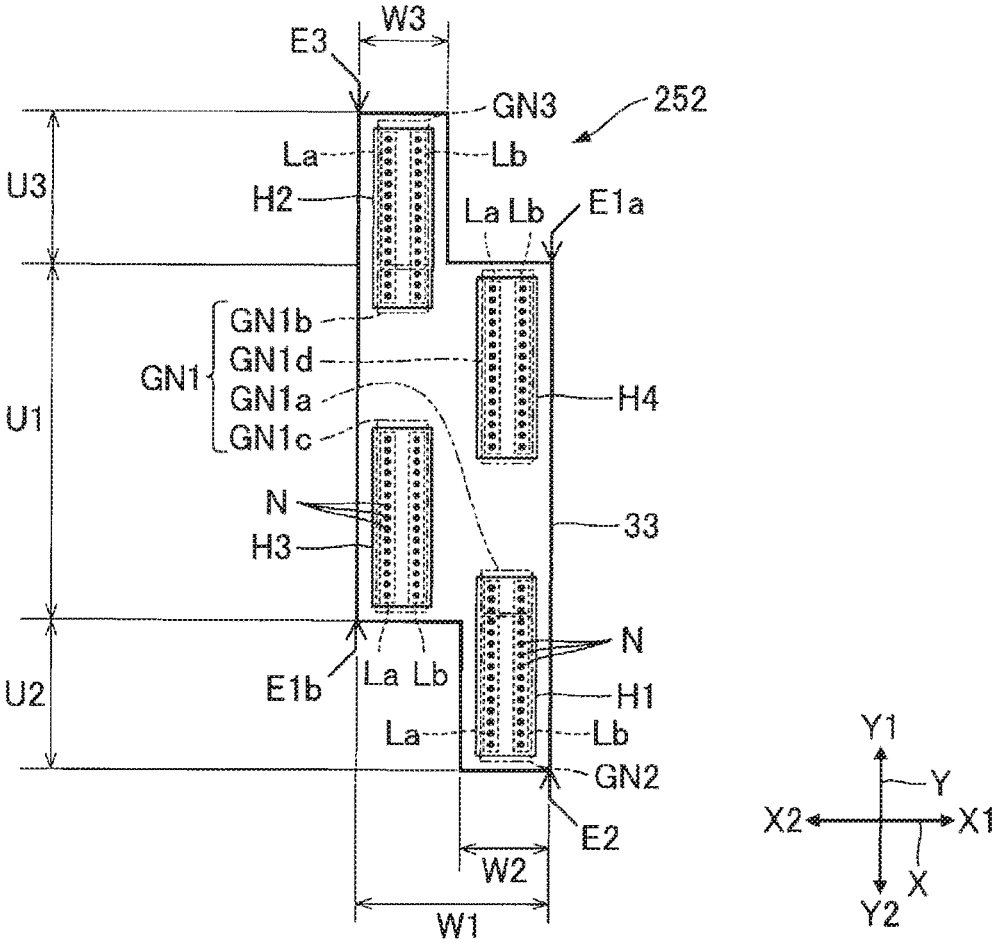
FIG. 5 is a plan diagram of a head unit as seen from a Z2 direction.

FIG. 5 is a plan diagram of the head unit 252 as seen from the Z2 direction. In FIG. 5, the illustration of the pair of flanges 334 is omitted for convenience of description. As illustrated in FIG. 5, a width W2 of the second portion U2 along the X axis is smaller than a width W1 of the first portion U1 along the X axis. Similarly, a width W3 of the third portion U3 along the X axis is smaller than the width W1 of the first portion U1 along the X axis. The width W2 and the width W3 illustrated in FIG. 4 are equal to each other. The width W2 and the width W3 may be different from each other. However, when the width W2 and the width W3 are equal to each other, it is possible to increase the symmetry of the shape of the head unit 252, and as a result, there is an advantage that the plurality of head units 252 can be easily arranged densely. Here, the widths W1, W2, and W3 of the first portion U1, the second portion U2, and the third portion U3 are the widths between the end portion on one side and the end portion on the other side along the X axis of each portion.

An end surface E1*a* of the first portion U1 in the X1 direction is a plane continuous with the end surface E2 of the second portion U2 in the X1 direction. On the other hand, an end surface E1*b* of the first portion U1 in the X2 direction is a plane continuous with an end surface E3 of the third portion U3 in the X2 direction. In addition, a recess or a protrusion may be appropriately provided on these end surfaces. Further, a step may be provided between the end surface E1*a* and the end surface E2, or a step may be provided between the end surface E1*b* and the end surface E3.

As illustrated in FIG. 5, the holder 33 of the head unit 252 holds four circulation heads Hn (n=1 to 4). Each circulation head Hn (n=1 to 4) discharges ink from a plurality of nozzles N. As illustrated in FIG. 5, the plurality of nozzles N are divided into a nozzle row La and a nozzle row Lb. Each of the nozzle row La and the nozzle row Lb is a set of a plurality of nozzles N arranged along the Y axis. The nozzle row La and the nozzle row Lb are provided side by side with an interval therebetween in the X axis direction. In the following description, a subscript a is added to the reference numeral of the element related to the nozzle row La, and a subscript b is added to the reference numeral of the element related to the nozzle row Lb.

The plurality of nozzles N provided in the four circulation heads H1 to H4 are divided into a first nozzle group GN1, a second nozzle group GN2, and a third nozzle group GN3. The first nozzle group GN1 is a set of a plurality of nozzles N provided in the first portion U1, among the plurality of nozzles N provided in the four circulation heads H1 to H4. The second nozzle group GN2 is a set of a plurality of nozzles N provided in the second portion U2 among the plurality of nozzles N provided in the four circulation heads H1 to H4. The third nozzle group GN3 is a set of a plurality of nozzles N provided in the third portion U3, among the plurality of nozzles N provided in the four circulation heads H1 to H4.

Here, the first nozzle group GN1 includes a nozzle group GN1*a* composed of a part of the plurality of nozzles N provided in the circulation head H1, a nozzle group GN1*b* composed of a part of the plurality of nozzles N provided in the circulation head H2, a nozzle group GN1*c* composed of all the plurality of nozzles N provided in the circulation head H3, and a nozzle group GN1*d* composed of all of the plurality of nozzles N provided in the circulation head H4. The second nozzle group GN2 is composed of a plurality of nozzles N except the nozzle group GN1*a* among the plurality of nozzles N provided in the circulation head H1. Similarly, the third nozzle group GN3 is composed of a plurality of nozzles N except the nozzle group GN1*b* among the plurality of nozzles N provided in the circulation head H2.

In addition, in the present embodiment, since most part of the circulation head H1 is provided in the second portion U2, the set of all the plurality of nozzles N provided in the circulation head H1 may be regarded as the second nozzle group GN2, approximatively. Similarly, approximatively, the set of all the plurality of nozzles N provided in the circulation head H2 may be regarded as the third nozzle group GN3. Further, the set of all the plurality of nozzles N provided in the circulation heads H3 and H4 may be regarded as the first nozzle group GN1 without including the plurality of nozzles N provided in one or both of the circulation heads H1 and H2.

1-3. Circulation Head Hn

Figure 6:
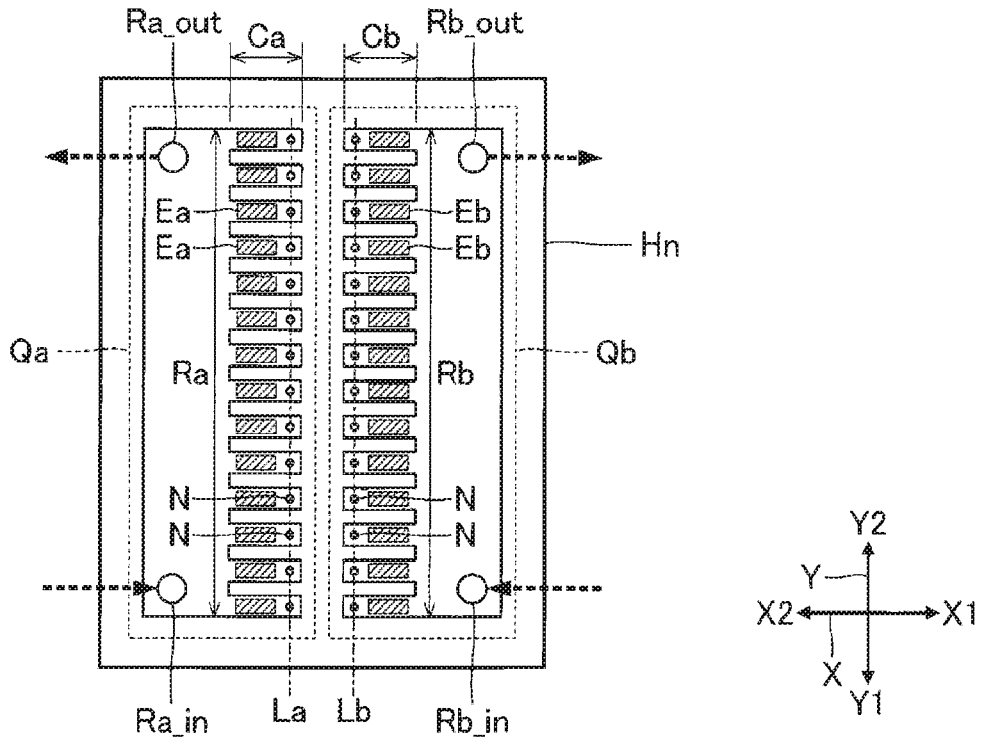
FIG. 6 is a plan diagram of a head.

FIG. 6 is a plan diagram of the circulation head Hn. FIG. 6 schematically illustrates an internal structure of the circulation head Hn as viewed from the Z1 direction. As illustrated in FIG. 6, each circulation head Hn includes a liquid discharge portion Qa and a liquid discharge portion Qb. The liquid discharge portion Qa of each circulation head Hn discharges the first ink supplied from the sub tank 13*a* from each nozzle N of the nozzle row La. The liquid discharge portion Qb of each circulation head Hn discharges the second ink supplied from the sub tank 13*b* from each nozzle N of the nozzle row Lb.

The liquid discharge portion Qa includes a liquid storage chamber Ra, a plurality of pressure chambers Ca, and a plurality of drive elements Ea. The liquid storage chamber Ra is a common liquid chamber that is continuous over the plurality of nozzles N of the nozzle row La. The pressure chamber Ca and the drive element Ea are formed for each nozzle N of the nozzle row La. The pressure chamber Ca is a space for communicating with the nozzle N. The plurality of pressure chambers Ca are filled with the first ink supplied from the liquid storage chamber Ra. The drive element Ea changes the pressure of the first ink in the pressure chamber Ca. For example, a piezoelectric element that changes the pressure in the pressure chamber Ca by deforming the wall surface of the pressure chamber Ca, or a heating element that generates bubbles in the pressure chamber Ca by heating the first ink in the pressure chamber Ca is preferably used as the drive element Ea. The drive element Ea changes the pressure of the first ink in the pressure chamber Ca, so that the first ink in the pressure chamber Ca is discharged from the nozzle N. That is, the drive element Ea functions as an energy generation element that generates energy for discharging ink from the nozzle N that communicates with the pressure chamber Ca.

The liquid discharge portion Qb includes a liquid storage chamber Rb, a plurality of pressure chambers Cb, and a plurality of drive elements Eb, like the liquid discharge portion Qa. The liquid storage chamber Rb is a common liquid chamber that is continuous over the plurality of nozzles N of the nozzle row Lb. The pressure chamber Cb and the drive element Eb are formed for each nozzle N of the nozzle row Lb. The plurality of pressure chambers Cb are filled with the second ink supplied from the liquid storage chamber Rb. The drive element Eb is, for example, the above-described piezoelectric element or heating element. The drive element Eb changes the pressure of the second ink in the pressure chamber Cb, so that the second ink in the pressure chamber Cb is discharged from the nozzle N. That is, the drive element Eb functions as an energy generation element that generates energy for discharging ink from the nozzle N that communicates with the pressure chamber Cb.

As illustrated in FIG. 6, each circulation head Hn is provided with a supply port Ra_in, a discharge port Ra_out, a supply port Rb_in, and a discharge port Rb_out. The supply port Ra_in and the discharge port Ra_out communicate with the liquid storage chamber Ra. The supply port Rb_in and the discharge port Rb_out communicate with the liquid storage chamber Rb.

Of the first ink stored in the liquid storage chamber Ra of each circulation head Hn, the first ink that is not discharged from each nozzle N of the nozzle row La circulates in the route of discharge port Ra_out→discharge flow path of the flow path member 31 for the first ink→sub tank 13*a* provided outside the head unit 252→supply flow path of the flow path member 31 for the first ink→supply port Ra_in→liquid storage chamber Ra. Similarly, of the second ink stored in the liquid storage chamber Rb of each circulation head Hn, the second ink that is not discharged from each nozzle N of the nozzle row Lb circulates in the route of discharge port Rb_out→discharge flow path of the flow path member 31 for the second ink→sub tank 13*b* provided outside the head unit 252→supply flow path of the flow path member 31 for the second ink→supply port Rb_in→liquid storage chamber Rb.

1-4. Discharge Amount from Head Unit 252

Figure 7:
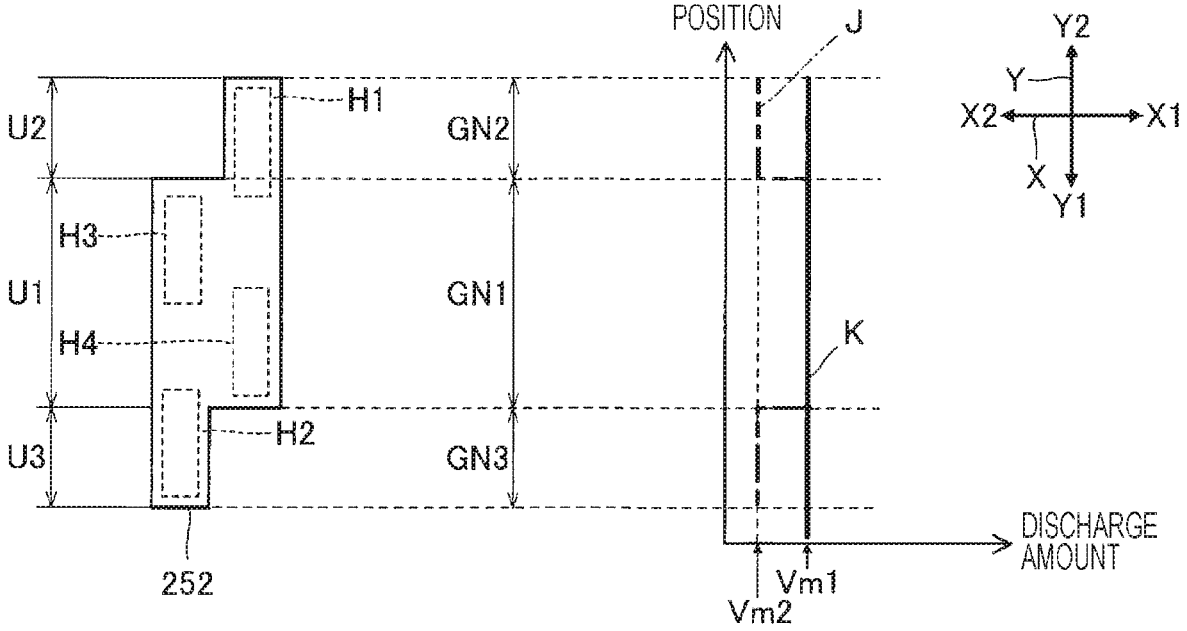
FIG. 7 is a diagram illustrating a relationship between a position of a head unit on a Y axis and a liquid discharge amount.

FIG. 7 is a diagram illustrating the relationship between the position of the head unit 252 on the Y axis and the ink discharge amount. When a common drive signal is used for all of the plurality of drive elements Ea and Eb in the head unit 252, as illustrated by a discharge amount distribution J in FIG. 7, a discharge amount Vm2 of ink discharged from the second nozzle group GN2 or the third nozzle group GN3 is smaller than a discharge amount Vm1 of ink discharged from the first nozzle group GN1. It is considered that such a discharge amount distribution J is caused by a difference in ink viscosity between the first portion U1 and the second portion U2 and between the first portion U1 and the third portion U3 caused by a temperature difference between the first portion U1 and the second portion U2 and a temperature difference between the first portion U1 and the third portion U3. Note that, the second portion U2 and the third portion U3 have similar characteristics (width difference, temperature difference, ink viscosity difference, and the like with the first portion U1). In view of this point, in the following description, the third portion U3 is treated the same as the second portion U2 unless otherwise specified, and the description of the third portion U3 and the third nozzle group GN3 which corresponds to the third portion U3 will be omitted.

More specifically, since the width of the second portion U2 is smaller than the width of the first portion U1, the heat capacity of the second portion U2 is smaller than that of the first portion U1. Therefore, the second portion U2 is more likely to dissipate heat than the first portion U1. As a result, the temperature of the second portion U2 becomes lower than the temperature of the first portion U1. In particular, when the holder 33 is made of metal, the heat capacity of the metal itself is large, so that the difference between the heat capacity of the second portion U2 and the heat capacity of the first portion U1 becomes significantly large.

On the other hand, ink generally increases in viscosity with a decrease in the temperature. Therefore, since the temperature of the second portion U2 becomes lower than the temperature of the first portion U1, the viscosity of the ink flowing through the second portion U2 becomes higher than the viscosity of the ink flowing through the first portion U1. As a result, even when the same drive signal is used, the ink discharge amount Vm2 from the second nozzle group GN2 becomes smaller than the ink discharge amount Vm1 from the first nozzle group GN1.

Note that, the discharge amount distribution J illustrated in FIG. 7 is constant regardless of the position of the discharge amount Vm1 or Vm2 on the Y axis for the convenience of the description, but, actually, the discharge amount Vm1 or Vm2 may differ depending on the position on the Y axis according to the temperature distribution or the like of the head unit 252.

The difference between the discharge amount Vm1 and the discharge amount Vm2 in the discharge amount distribution J as described above causes deterioration of the image quality of the image printed on the medium 11. For example, when an image having a uniform density is printed on the medium 11 and the same drive signal is used for all the nozzles N, a local density difference or an overall density unevenness occurs in the image printed on the medium 11.

Therefore, in the liquid discharge apparatus 100 of the present embodiment, when an image having a uniform density is to be printed on the medium 11, as illustrated by a discharge amount distribution K in FIG. 7, the drive of the head unit 252 is controlled so that the discharge amount of the ink is constant at the discharge amount Vm1 over the first nozzle group GN1, the second nozzle group GN2, and the third nozzle group GN3. Hereinafter, this point will be described in detail. When an image with a non-uniform density is to be printed on the medium 11, control according to the above control is performed so that an image with a desired density is printed.

1-5. Control Section 211

Figure 8:
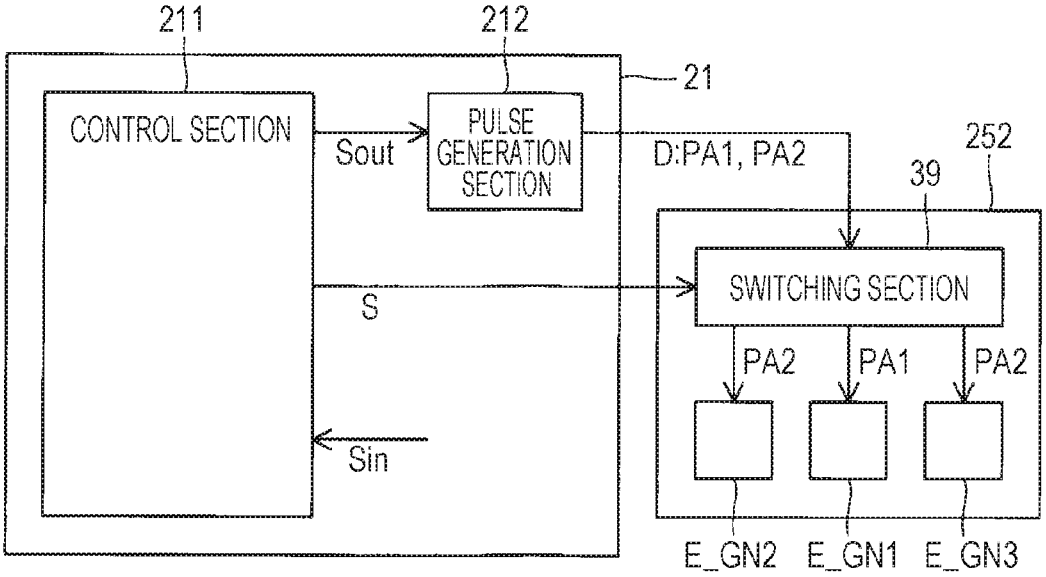
FIG. 8 is a diagram for explaining a control section according to a first embodiment.

FIG. 8 is a diagram for explaining the control section 211 in the first embodiment. As illustrated in FIG. 8, the control unit 21 supplies a plurality of signals including the control signal S and the drive signal D to the head unit 252. The control signal S is a signal that is output from the control section 211 and that instructs whether ink is to be discharged or not for each of the plurality of drive elements Ea or Eb for each unit period of a predetermined length. The control section 211 receives the input value Sin based on the print information or the like and outputs the output value Sout based on the input value Sin. In the present embodiment, the output value Sout corresponds to the amount of energy given by the pulse. Here, even when the input value Sin which corresponds to the first nozzle group GN1 and the input value Sin which corresponds to the second nozzle group GN2 are the same as each other, the output value Sout which corresponds to the second nozzle group GN2 is larger than the output value Sout which corresponds to the first nozzle group GN1 so as to reduce the difference between the discharge amount Vm1 and the discharge amount Vm2 in the above-described discharge amount distribution J. That is, the energy generated by the pulse applied to the second nozzle group GN2 is made larger than the energy generated by the pulse applied to the first nozzle group GN1.

The pulse generation section 212 generates the drive signal D based on the output value Sout. The drive signal D is a voltage signal that is output from the pulse generation section 212 and that changes with the unit period as a cycle. The drive signal D includes a first pulse PA1 and a second pulse PA2 for each unit period. The first pulse PA1 is a voltage waveform for causing ink to be ejected from the first nozzle group GN1. The second pulse PA2 is a voltage waveform for causing ink to be ejected from the second nozzle group GN2. Note that, examples of specific waveforms of the first pulse PA1 and the second pulse PA2 will be described later.

As illustrated in FIG. 8, a switching section 39 is provided in the head unit 252. The switching section 39 is a switching circuit that supplies the first pulse PA1 or the second pulse PA2 of the drive signal D based on the control signal S to each of the plurality of drive elements Ea or Eb for each unit period. Specifically, the switching section 39 supplies the first pulse PA1 to a first drive element E_GN1 which is a drive element Ea or Eb corresponding to the first nozzle group GN1. Further, the switching section 39 supplies the second pulse PA2 to each of a second drive element E_GN2 which is a drive element Ea or Eb corresponding to the second nozzle group GN2 and a third drive element E_GN3 which is a drive element Ea or Eb corresponding to the third nozzle group GN3.

Note that, FIG. 8 illustrates a case where both the first pulse PA1 and the second pulse PA2 are included in the unit period of one drive signal D, but the present disclosure is not limited to this example. For example, the drive signal including the first pulse PA1 and the drive signal including the second pulse PA2 may be separately generated by the pulse generation section 212. In this case, the drive signal including the first pulse PA1 may be supplied to the first drive element E_GN1, and the drive signal including the second pulse PA2 may be supplied to each of the second drive element E_GN2 and the third drive element E_GN3. Further, the switching section 39 may be provided outside the head unit 252.

1-6. First Pulse PA1 and Second Pulse PA2

Hereinafter, Examples 1, 2, 3, and 4 of specific waveforms of the first pulse PA1 and the second pulse PA2 will be sequentially described.

Example 1

Figure 9:
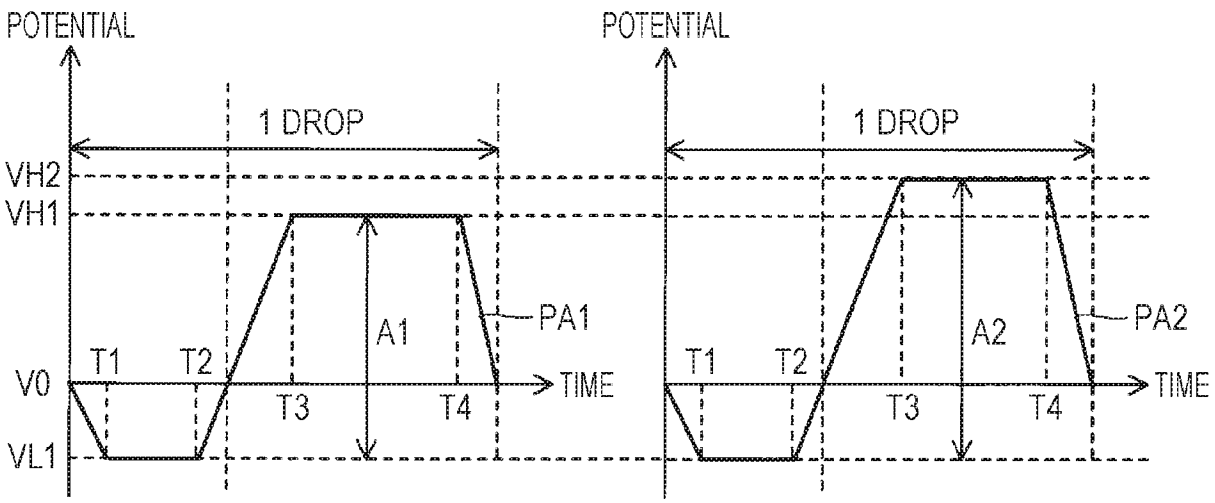
FIG. 9 is a diagram illustrating a first pulse and a second pulse in Example 1.

FIG. 9 is a diagram illustrating the first pulse PA1 and the second pulse PA2 in Example 1. As illustrated in FIG. 9, each of potentials of the first pulse PA1 and the second pulse PA2 in Example 1 drops until the first timing T1, then rises from the second timing T2 to the third timing T3, and thereafter, drops from the fourth timing T4. Here, the first pulse PA1 or the second pulse PA2 causes the pressure chamber Ca or Cb described above to be depressurized in the period until the second timing T2, and causes the pressure chamber Ca or Cb to be pressurized in the period from the second timing T2 to the third timing T3. Due to the change in the pressure inside the pressure chamber Ca or Cb as described above, a part of the ink inside the pressure chamber Ca or Cb is discharged from the nozzle N as a droplet.

In Example 1, the potential of the first pulse PA1 from the third timing T3 to the fourth timing T4 is a potential VH1, while the potential of the second pulse PA2 from the third timing T3 to the fourth timing T4 is a potential VH2 higher than the potential VH1. That is, when the second pulse PA2 is applied, pressurization is performed so that the pressure becomes higher than that when the first pulse PA1 is applied. The higher the pressure becomes when pressurized, the larger the discharge amount, because the amount of ink pushed out during discharge is large. Therefore, by applying the first pulse PA1 in Example 1 to the first nozzle group GN1 and applying the second pulse PA2 in Example 1 to the second nozzle group GN2, the difference between the discharge amount Vm1 and the discharge amount Vm2 in the discharge amount distribution J illustrated in FIG. 7 can be reduced.

In FIG. 9, the potential of the first pulse PA1 from the first timing T1 to the second timing T2 and the potential of the second pulse PA2 from the first timing T1 to the second timing T2 are equal to each other at a potential VL1. Therefore, an amplitude A2 of the second pulse PA2 represented by a difference between a potential VH2 and the potential VL1 is larger than an amplitude A1 of the first pulse PA1 represented by a difference between a potential VH1 and the potential VL1. Each of the potentials VH1 and VH2 is a potential higher than a reference potential V0. The potential VL1 is lower than the reference potential V0.

The difference between the potential VH1 and the potential VH2 may be fixed or variable. When the difference is variable, for example, a temperature sensor provided in the head unit 252 measures temperatures of the first portion U1 and the second portion U2, and based on the difference between the measured values, the difference between the potential VH1 and the potential VH2 may be changed.

Example 2

Figure 10:
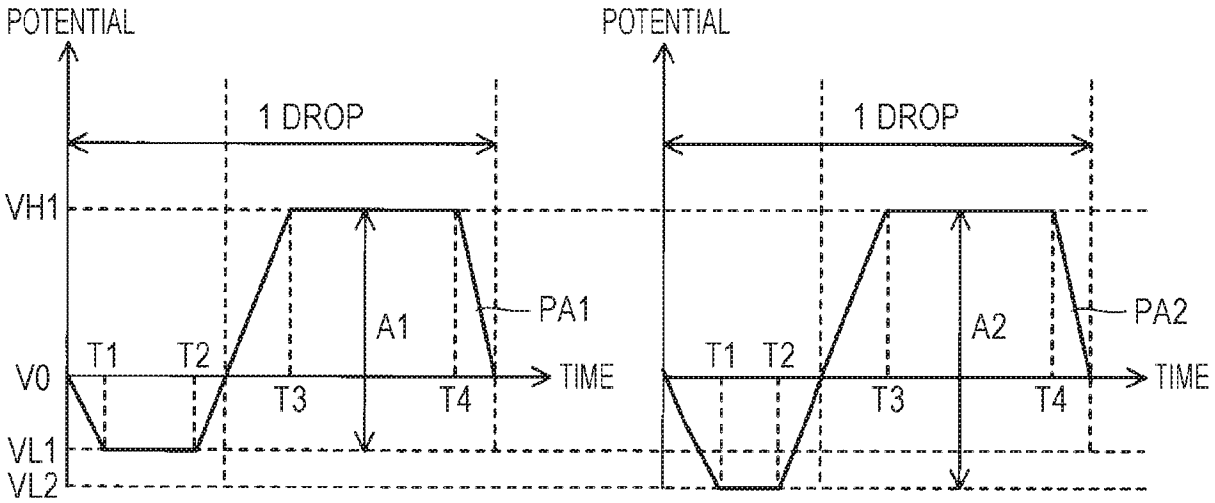
FIG. 10 is a diagram illustrating a first pulse and a second pulse in Example 2.

FIG. 10 is a diagram illustrating the first pulse PA1 and the second pulse PA2 in Example 2. As illustrated in FIG. 10, the first pulse PA1 in Example 2 is the same as the first pulse PA1 in Example 1 described above. In Example 2, the potential of the first pulse PA1 from the first timing T1 to the second timing T2 is the potential VL1, while the potential of the second pulse PA2 from the first timing T1 to the second timing T2 is the potential VL2 lower than the potential VL1. That is, when the second pulse PA2 is applied, the depressurization is performed so that the pressure becomes lower than that when the first pulse PA1 is applied. The lower the pressure becomes when depressurized, the larger the discharge amount, because the amount of liquid drawn into the pressure chamber Ca or Cb for discharge increases. Therefore, by applying the first pulse PA1 in Example 2 to the first nozzle group GN1 and the second pulse PA2 in Example 2 to the second nozzle group GN2, the difference between the discharge amount Vm1 and the discharge amount Vm2 in the discharge amount distribution J illustrated in FIG. 7 can be reduced.

Note that, in FIG. 10, the potential of the first pulse PA1 from the third timing T3 to the fourth timing 14 and the potential of the second pulse PA2 from the third timing T3 to the fourth timing T4 are equal to each other at the potential VH1. Therefore, the amplitude A2 of the second pulse PA2 represented by the difference between the potential VH1 and the potential VL2 is larger than the amplitude A1 of the first pulse PA1 represented by the difference between the potential VH1 and the potential VL1. The potential VL2 is lower than the reference potential V0.

Example 3

Figure 11:
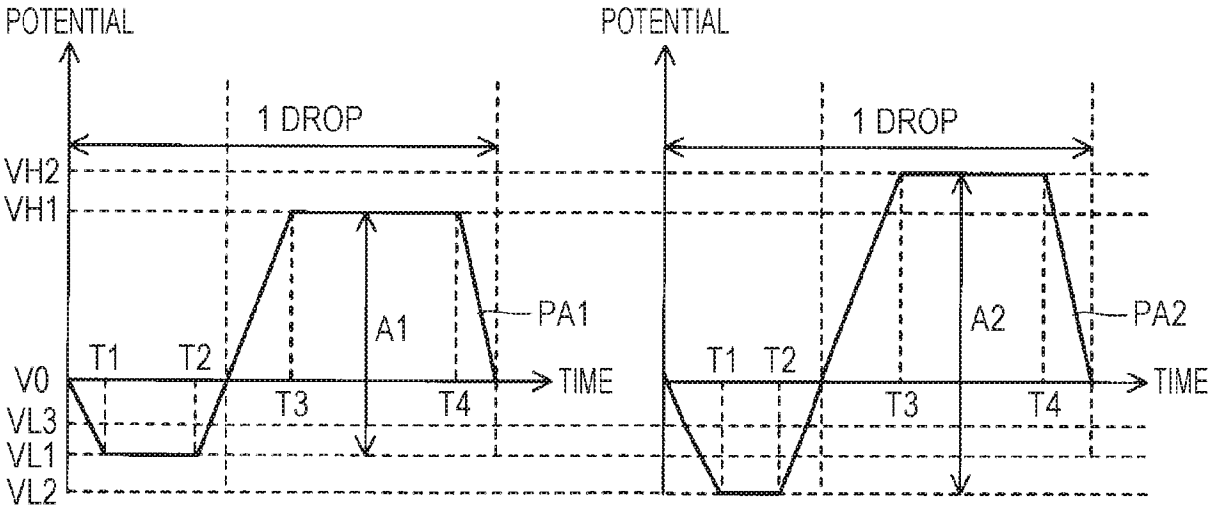
FIG. 11 is a diagram illustrating a first pulse and a second pulse in Example 3.

FIG. 11 is a diagram illustrating the first pulse PA1 and the second pulse PA2 in Example 3. As illustrated in FIG. 11, the first pulse PA1 in Example 3 is the same as the first pulse PA1 in Example 1 described above. The second pulse PA2 in Example 3 has a waveform that is a combination of the second pulses PA2 in Examples 1 and 2 described above. That is, in Example 3, as in Example 2 described above, the potential of the first pulse PA1 from the first timing T1 to the second timing T2 is the potential VL1, while the potential of the second pulse PA2 from the first timing T1 to the second timing T2 is the potential VL2 lower than the potential VL1. In addition to this, as in a case of the above-described Example 1, the potential of the first pulse PA1 from the third timing T3 to the fourth timing 14 is the potential VH1, while the potential of the second pulse PA2 from the third timing T3 to the fourth timing 14 is the potential VH2 higher than the potential VH1.

Also in the above Example 3, the difference between the discharge amount Vm1 and the discharge amount Vm2 in the discharge amount distribution J can be reduced. Note that, in the amplitude A2 of the second pulse PA2, as long as it is larger than the amplitude A1 of the first pulse PA1, a potential of the second pulse PA2 from the first timing T1 to the second timing T2 may be the potential VL3 higher than the potential VL1.

Example 4

Figure 12:
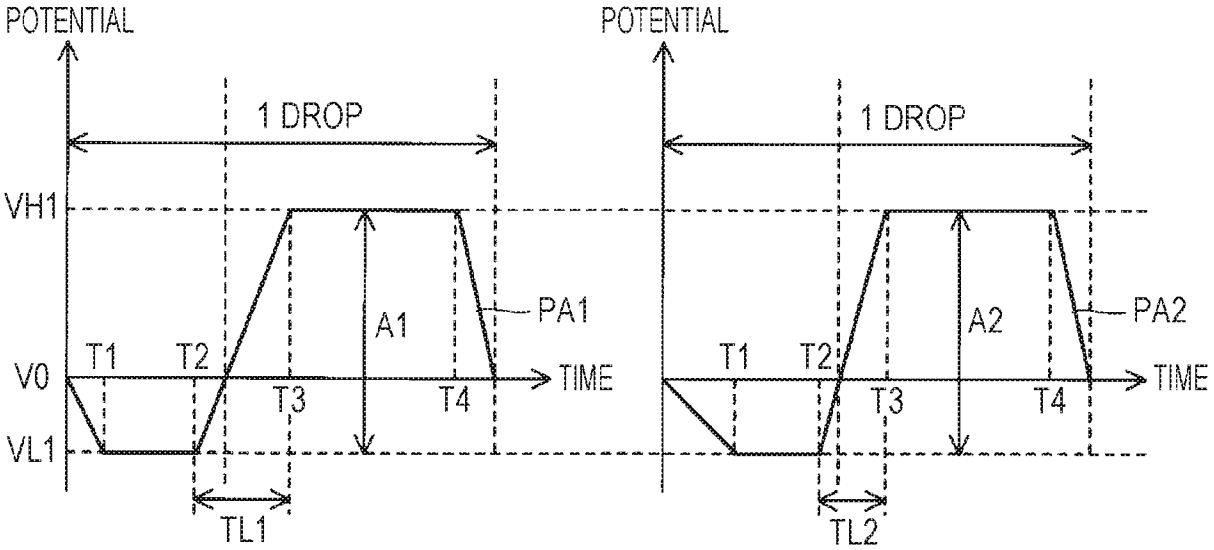
FIG. 12 is a diagram illustrating a first pulse and a second pulse in Example 4.

FIG. 12 is a diagram illustrating the first pulse PA1 and the second pulse PA2 in Example 4. As illustrated in FIG. 12, the first pulse PA1 in Example 4 is the same as the first pulse PA1 in Example 1 described above. In Example 4, the time length of the first pulse PA1 from the second timing T2 to the third timing T3 is the time length TL1, while the time length of the second pulse PA2 from the second timing T2 to the third timing T3 is a time length TL2 smaller than the time length TL1.

That is, when the second pulse PA2 is applied, the pressure is applied rapidly during the pressurization as compared with the first pulse PA1. The discharge amount is larger when the pressure is applied rapidly than when the pressure is applied slowly. Therefore, by applying the first pulse PA1 in Example 4 to the first nozzle group GN1 and the second pulse PA2 to the second nozzle group GN2, the difference between the discharge amount Vm1 and the discharge amount Vm2 in the discharge amount distribution illustrated in FIG. 7 can be reduced.

Example 4 may be combined with any of Examples 1 to 3 described above.

As can be understood from the above, the liquid discharge apparatus 100 includes a head unit 252 provided with a plurality of nozzles N that discharge ink, which is an example of a liquid, and a control section 211 that controls the ink discharge operation of the head unit 252.

The head unit 252 has a first portion U1 and a second portion U2. The second portion U2 is different from the first portion U1 in a position in the Y1 direction or Y2 direction corresponding to the first direction, and the width of the second portion U2 in the X1 direction or the X2 direction corresponding to the second direction intersecting the Y1 direction or the Y2 direction is smaller than that of the first portion U1.

Here, the plurality of nozzles N provided in the head unit 252 include a first nozzle group GN1 provided in the first portion U1 and a second nozzle group GN2 provided in the second portion U2. As described above, when the input value Sin which corresponds to the first nozzle group GN1 and the input value Sin which corresponds to the second nozzle group GN2 are the same as each other, the output value Sout which corresponds to the second nozzle group GN2 is larger than the output value Sout which corresponds to the first nozzle group GN1. That is, the control section 211 outputs a first output value as the output value Sout which corresponds to the first nozzle group GN1 when a first input value is input as the input value Sin which corresponds to the first nozzle group GN1. On the other hand, the control section 211 outputs a second output value larger than the first output value as the output value Sout which corresponds to the second nozzle group GN2 when the first input value is input as the input value Sin which corresponds to the second nozzle group GN2. Therefore, it is possible to reduce the discharge amount difference between the first nozzle group GN1 and the second nozzle group GN2 caused by the temperature difference between the first portion U1 and the second portion U2. As a result, the image quality can be improved as compared with a case where the output value Sout which corresponds to the first nozzle group GN1 and the output value Sout which corresponds to the second nozzle group GN2 are equal to each other.

The head unit 252 includes a first drive element E_GN1 that is a first energy generation element, a second drive element E_GN2 that is a second energy generation element, and a pulse generation section 212. The first drive element E_GN1 generates energy for discharging ink from the first nozzle group GN1. The second drive element E_GN2 generates energy for discharging ink from the second nozzle group GN2. The pulse generation section 212 generates the pulses for driving the first drive element E_GN1 and the second drive element E_GN2.

In the present embodiment, when the input values which respectively correspond to the first nozzle group GN1 and the second nozzle group GN2 in the control section 211 are the above-described first input value, the pulse supplied from the pulse generation section 212 to the first drive element E_GN1 is the first pulse PA1. Further, in this case, the pulse supplied from the pulse generation section 212 to the second drive element E_GN2 is the second pulse PA2.

Each of potentials of the first pulse PA1 and the second pulse PA2 drops until the first timing T1, then rise from the second timing T2 after the first timing T1 to the third timing T3 after the second timing T2, and thereafter, drop from the fourth timing T4 after the third timing T3. By using the first pulse PA1 and the second pulse PA2 of which potential changes in this way, ink can be efficiently discharged from the first nozzle group GN1 and the second nozzle group GN2. Further, by making the amplitudes of the first pulse PA1 and the second pulse PA2 or the time widths of the respective parts different from each other, it is possible to reduce the discharge amount difference between the first nozzle group GN1 and the second nozzle group GN2 caused by the temperature difference between the first portion U1 and the second portion U2.

As illustrated in FIG. 9 or FIG. 11 described above, the potential VH2 of the second pulse PA2 between the third timing T3 and the fourth timing T4 is preferably higher than the potential VH1 of the first pulse PA1 between the third timing T3 and the fourth timing T4. In this case, compared to a case where the potential VH1 and the potential VH2 are equal to each other, it is easier to increase the discharge amount from the second nozzle group GN2.

Further, as illustrated in FIG. 10 or FIG. 11 described above, the potential VL2 of the second pulse PA2 between the first timing T1 and the second timing T2 is preferably lower than the potential VL1 of the first pulse PA1 between the first timing T1 and the second timing T2. In this case, compared to a case where the potential VL1 and the potential VL2 are equal to each other, it is easier to increase the amplitude A2 of the second pulse PA2.

Further, as illustrated in FIG. 12 described above, the time length of the second pulse PA2 between the second timing T2 and the third timing T3 is preferably smaller than the time length of the first pulse PA1 between the second timing T2 and the third timing T3. In this case, even when the amplitude A2 of the second pulse PA2 is reduced, the discharge amount from the second nozzle group GN2 can be increased as compared with a case where the second pulse PA2 has the same waveform as the first pulse PAL Further, the head unit 252 further includes a third portion U3 having a width in the X1 direction or the X2 direction smaller than the first portion U1. The second portion U2 and the third portion U3 have different positions in the Y1 direction or the Y2 direction. Further, as illustrated in FIGS. 4 and 5, each of the plurality of nozzles N provided in the head unit 252 is provided in any of the first portion U1, the second portion U2, and the third portion U3. That is, the nozzle N is not provided in the portion of the head unit 252 other than the first portion U1, the second portion U2, and the third portion U3. Therefore, it is easy to reduce the installation space for the plurality of head units 252.

Further, as illustrated in FIGS. 4 and 5, the second portion U2 is coupled to the first portion U1 in the Y2 direction with respect to the first portion U1, while the third portion U3 is coupled to the first portion U1 in the Y1 direction with respect to the first portion U1. Therefore, it is easy to design the head unit 252 capable of reducing the installation space as described above. Here, the Y2 direction corresponds to the "first side" that is one side of the Y1 direction or the Y2 direction, and the Y1 direction corresponds to the "second side" that is the other side of the Y1 direction or the Y2 direction.

Further, as illustrated in FIG. 5, the end surface E2 on a third side, which is one side in the X1 direction or the X2 direction of the second portion U2, has the same position as the end surface E1*a* of the first portion U1 on the third side in the X1 direction or the X2 direction. In other words, the end surface E2 and the end surface E1*a* form a continuous plane. Similarly, the position of the end surface E3 of the third portion U3 on a fourth side which is the other side in the X1 direction or the X2 direction, and the position of the end surface E1*b* of the first portion U1 on the fourth side are the same in the X1 direction or the X2 direction. Therefore, compared with a case where a step is provided between the end surface E2 and the end surface E1*a* or a step is provided between the end surface E3 and the end surface E1*b*, a plurality of head units 252 can be densely disposed in the X1 direction or the X2 direction.

As illustrated in FIG. 5, the head unit 252 includes a circulation head H1, a part of which is positioned in the second portion U2 and the other part of which is positioned in the first portion U1, and a circulation head H2, a part of which is positioned in the third portion U3 and the other part of which is positioned in the first portion U1. Therefore, the plurality of nozzles N can be evenly disposed along the Y axis over the first portion U1, the second portion U2, and the third portion U3. Here, the circulation head H1 corresponds to a "first head" in which a part of the plurality of nozzles N included in the head unit 252 is provided. The circulation head H2 corresponds to a "second head" in which a part of the plurality of nozzles N included in the head unit 252 is provided.

As illustrated in FIG. 5, in addition to the circulation heads H1 and H2 described above, the head unit 252 has a circulation head H3 positioned in the first portion U1 and a circulation head H4 positioned in the first portion U1, which is different from the circulation head H3 in the position in the Y1 direction or the Y2 direction. In the configuration using the circulation heads H1 to H4, the number of nozzles N included in the head unit 252 can be increased without increasing the number of nozzles N in the circulation heads H1 and H2 as compared with the configuration using only the circulation heads H1 and H2. Therefore, it is easy to increase the number of nozzles N included in the head unit 252. Here, the circulation head H3 corresponds to a "third head" in which a part of the plurality of nozzles N included in the head unit 252 is provided. The circulation head H4 corresponds to a "fourth head" in which a part of the plurality of nozzles N included in the head unit 252 is provided.

Further, as illustrated in FIG. 3, the head unit 252 further includes a holder 33 in which the circulation heads H1 and H2 are disposed. Therefore, the circulation heads H1 and H2 can be integrated by the holder 33. In addition to the circulation heads H1 and H2, the circulation heads H3 and H4 are also disposed in the holder 33 of the present embodiment. Therefore, the circulation heads H1 to H4 are integrated by the holder 33.

Further, as illustrated in FIG. 3, the head unit 252 further includes a fixing plate 36 that fixes the circulation heads H1 and H2 to the holder 33. For this reason, the integrity of the circulation heads H1 and H2 can be enhanced as compared with the configuration in which the fixing plate 36 is not used. The fixing plate 36 of the present embodiment also fixes the circulation heads H3 and H4 to the holder 33, in addition to the circulation heads H1 and H2. Therefore, the integrity of the circulation heads H1 to H4 is enhanced.

As illustrated in FIG. 5, each of the circulation heads H1 and H2 has the nozzle rows La and Lb. In each of the nozzle rows La and Lb, a part of a plurality of nozzles N included in the head unit 252 is arranged in the Y1 direction or the Y2 direction. Therefore, the pitch between the nozzles N in the nozzle row La or Lb can be made smaller than in the configuration in which the nozzle row La or Lb extends over the circulation head H1 and the circulation head H2.

2. Second Embodiment

In the above-described embodiment, the discharge amount difference between the first nozzle group GN1 and the second nozzle group GN2 is reduced by directly differentiating the first pulse PA1 and the second pulse PA2 from each other. However, in the present embodiment, a γ correction is made different between pre-correction data which corresponds to the first nozzle group GN1 and pre-correction data which corresponds to the second nozzle group GN2 to reduce the discharge amount difference indicated by the discharge amount distribution J.

Figure 13:
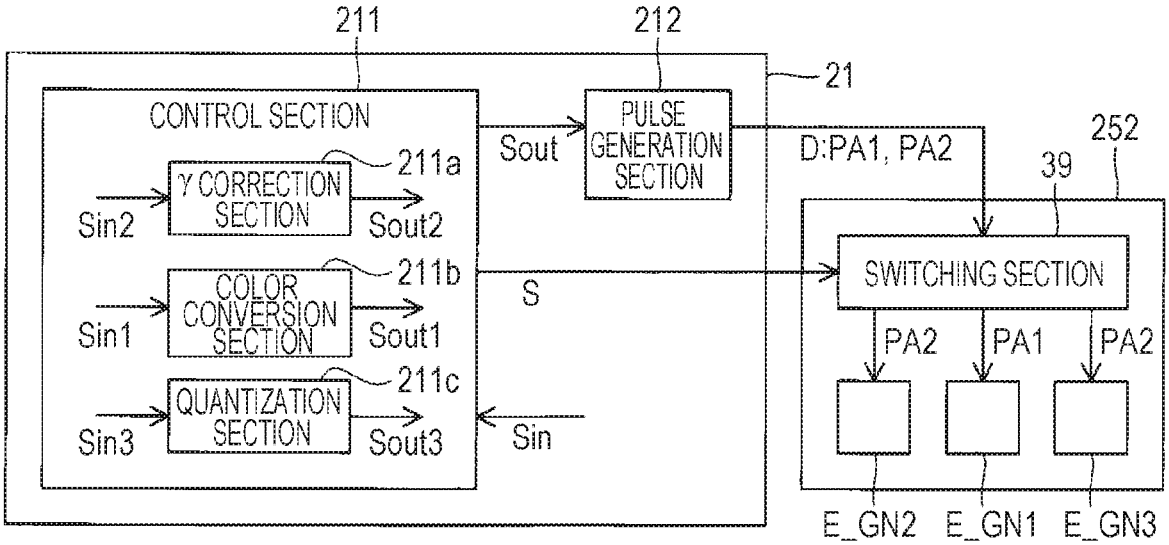
FIG. 13 is a diagram for explaining a control section according to a second embodiment.

FIG. 13 is a diagram for explaining the control section 211 in the second embodiment. As illustrated in FIG. 13, the control section 211 of the present embodiment includes a γ correction section 211*a*, a color conversion section 211*b*, and a quantization section 211*c*.

Figure 14:
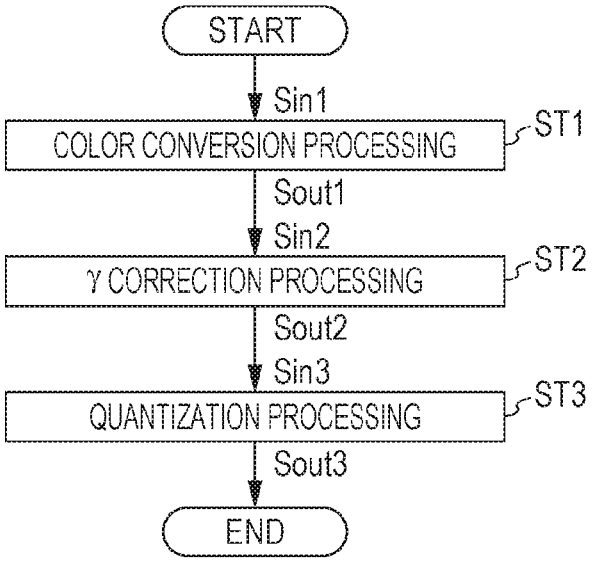
FIG. 14 is a diagram illustrating a flow of processing of the control section according to a second embodiment.

Further, FIG. 14 is a diagram illustrating a flow of processing of the control section 211 in the second embodiment. As illustrated in FIG. 14, the control section 211 executes color conversion processing ST1 by the color conversion section 211*b*, γ correction processing ST2 by the γ correction section 211*a*, and quantization processing ST3 by the quantization section 211*c* in this order.

First, the color conversion section 211*b* performs the color conversion processing ST1. In the color conversion processing ST1, first color space data Sin1 which corresponds to a first color space including at least red, green, and blue is converted into second color space data Sout1 which corresponds to a second color space including at least cyan, magenta, and yellow.

The first color space is a color space such as an sRGB color space used for color reproduction on a PC or the like. The first color space data Sin1 is data represented by RGB values (luminance values) and the like. The second color space is a color space such as a CMYK color space used for color reproduction in a printer or the like. The second color space data Sout1 is data represented by CMY values (density values) and the like. That is, the color conversion processing ST1 is processing of converting a data format of the PC or the like into a data format of the printer or the like so that the image represented by the PC or the like can be recorded by the printer.

In order to perform the color conversion processing ST1, a color conversion look up table (LUT) that defines a correspondence relationship between a luminance value and a density value is used. The correspondence relationship between the first color space data Sin1 and the second color space data Sout1 is defined in the color conversion LUT. For example, when the first color space data Sin1 having a value of (R, G, B)=(0, 0, 0) is input, the second color space data Sout1 having a value of (C, M, Y)=(255, 255, 255) is generated. In the color conversion processing ST1, when the first color space data Sin1 indicated by the luminance value is input, it is converted into the second color space data Sout1 indicated by the corresponding density value by referring to the color conversion LUT.

Next, the γ correction section 211*a* performs the γ correction processing ST2. The γ correction processing is processing of correcting the pre-correction data Sin2 which corresponds to the second color space including at least cyan, magenta, and yellow to generate post-correction data Sout2. The post-correction data Sout2 has a gradation value different from that of the pre-correction data Sin2 at least in part.

Here, in the present embodiment, for simplicity, other processing is not performed between the color conversion processing ST1 and the γ correction processing ST2. Therefore, the second color space data Sout1 generated in the color conversion processing ST1 and the pre-correction data Sin2 for which the γ correction processing ST2 is to be performed match. However, other processing may be performed between the color conversion processing ST1 and the γ correction processing ST2, and the second color space data Sout1 and the pre-correction data Sin2 may be different.

Since the printer reproduces the image by dots, the change in the density of the recorded image when the gradation is increased does not match between when the low gradation (low duty) image is recorded and when the high gradation (high duty) image is recorded. This is because the ratio of the coverage area of dots to paper white in the recording medium is different depending on the gradation value, that is, the number of dots and the type of recording medium at that time. Therefore, for example, even when it is designed such that the density of the image to be recorded changes linearly according to the pre-correction data Sin2, the density of the image actually recorded may vary depending on the gradation value or the type of the recording medium.

In view of this point, in the γ correction processing ST2, the pre-correction data Sin2 is corrected to generate post-correction data Sout2 so that the density of the image to be recorded also changes as desired with the change of the pre-correction data Sin2. For example, when the value of the pre-correction data Sin2 is low, the density of the recorded image tends to be low, and when the pre-correction data is high, the density of the recorded image tends to be high, when the value of the pre-correction data Sin2 is low, the post-correction data Sout2 is corrected to be large to some extent, and when the pre-correction data Sin2 is high, the post-correction data Sout2 is corrected to be small to some extent.

Then, the quantization section 211*c* performs the quantization processing ST3. In the quantization processing, corresponding to the second color space including at least cyan, magenta, and yellow, N-value data Sin3 indicating an N-value, N is an integer, is quantized to generate M-value data Sout3 indicating an M-value, M is an integer less than N and greater than 1.

Here, in the present embodiment, for simplicity, other processing is not performed between the γ correction processing ST2 and the quantization processing ST3. Therefore, the post-correction data Sout2 generated in the γ correction processing ST2 and the N-value data Sin3 for which the quantization processing ST3 is performed match. However, other processing may be performed between the γ correction processing ST2 and the quantization processing ST3, and the post-correction data Sout2 and the N-value data Sin3 may be different.

In a PC or the like, data is generally held in a multivalue, for example, 256-value. Therefore, the N-value data Sin3 is also represented by 256-value or the like. On the other hand, when an image is recorded by a printer or the like, it is necessary for the printer to hold the data with a smaller value, generally a binary value (or a quaternary value). Therefore, it is necessary to convert the N-value data Sin3 of 256-value into the M-value data Sout3 of binary value in the correction processing.

Therefore, in the quantization processing ST3, the N-value data Sin3 is quantized into the M-value data Sout3. At this time, an index pattern method, an error diffusion method, a dither method, or the like can be applied as the quantization method, and here, the dither method will be described.

In the dither method performed when quantizing 256-value N-value data Sin3 into binary M-value data Sout3, a dither pattern in which a threshold of 0 to 255 is determined for each of a plurality of pixels is used. One pixel of the N-value data corresponds to a plurality of pixels in the dither pattern. When the N-value data Sin3 is a predetermined value, M-value data Sout3 is generated so that the discharge of ink is defined for the pixel for which a threshold smaller than the predetermined value is determined, and the non-discharge of ink is defined for the pixel for which a threshold of the predetermined value or more is determined. At this time, when the number of pixels for which the threshold of 0 to 255 is determined in the dither pattern is approximately the same, even when the N-value data Sin3 is quantized into the M-value data Sout3, approximate density reproduction is possible.

By performing the color conversion processing ST1, the γ correction processing ST2, and the quantization processing ST3 described above, record data used for printing by the printer is generated.

In the following description, the input value indicated by the first color space data Sin1 is also simply referred to as the first color space data Sin1 for simplicity. Further, the output value indicated by the second color space data Sout1 is also simply referred to as the second color space data Sout1. Further, the input value indicated by the pre-correction data Sin2 is also simply referred to as the pre-correction data Sin2. Further, the output value indicated by the post-correction data Sout2 is also simply referred to as the post-correction data Sout2. Further, the input value indicated by the N-value data Sin3 is also simply referred to as N-value data Sin3. Further, the output value indicated by the M-value data Sout3 is also simply referred to as M-value data Sout3.

Further, the input value indicated by the first color space data Sin1 and the output value indicated by the second color space data Sout1 refer to a value indicating at least one certain color, and preferably, the first color space data Sin1 refers to all three RGB values, and the second color space data Sout1 refers to all three CMY values.

Further, the input value indicated by the pre-correction data Sin2 and the output value indicated by the post-correction data Sout2 refer to a value indicating at least one color, preferably all three CMY values.

Further, the input value indicated by the N-value data Sin3 refers to a value indicating at least one color, preferably all three CMY values.

Further, the output value indicated by the M-value data Sout3 refers to a value indicating at least one color, preferably all three CMY values. Here, in the M-value data Sout3, the output value does not refer to the value for each pixel, but refers to the total of the M-value data Sout3 in the pixel group composed of a plurality of pixels. That is, when the pixel group composed of 2 pixels×2 pixels is the unit of the M-value data Sout3, when the M-value data Sout3 is "1" in each of the 2 pixels×2 pixels, the value indicated by the M-value data Sout3 is 1×4="4". Since the M-value data Sout3 has a different number of gradations (whether binary or 256-value) from other data, the value indicated by the M-value data Sout3 is evaluated by a method different from that of the other data.

Here, as described above, in the present embodiment, the γ correction is made different between the pre-correction data Sin2 which corresponds to the first nozzle group GN1 and the pre-correction data Sin2 which corresponds to the second nozzle group GN2.

Figures 15, 16:
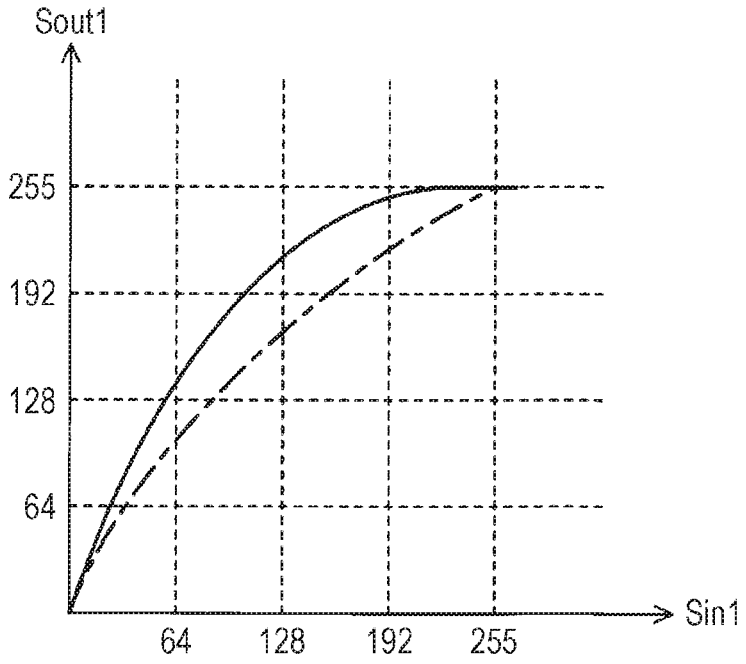
FIG. 15 is a graph illustrating an example of a relationship between a value of first gradation information and a value of second gradation information.
FIG. 16 is a table illustrating an example of a relationship between the value of the first gradation information and the value of the second gradation information.

FIG. 15 is a diagram for explaining the correction performed in the γ correction processing ST2 in the present embodiment. In other words, FIG. 15 illustrates the correspondence relationship between the pre-correction data Sin2 and the post-correction data Sout2. In FIG. 15, the solid line corresponds to the first nozzle group GN1 and the broken line corresponds to the second nozzle group GN2. FIG. 16 is a table illustrating an example of a relationship between the pre-correction data Sin2 and the post-correction data Sout2.

As can be seen from FIGS. 15 and 16, even when the same pre-correction data Sin1 is input, the post-correction data Sout2 generated in the second nozzle group GN2 is greater than the post-correction data Sout2 generated in the first nozzle group GN1. Therefore, it is possible to reduce the discharge amount difference between the first nozzle group GN1 and the second nozzle group GN2 indicated by the discharge amount distribution J of FIG. 7.

3. Third Embodiment

In the present embodiment, the discharge amount difference indicated by the discharge amount distribution J is reduced by differentiating the quantization processing between the N-value data which corresponds to the first nozzle group GN1 and the N-value data which corresponds to the second nozzle group GN2.

Figure 17:
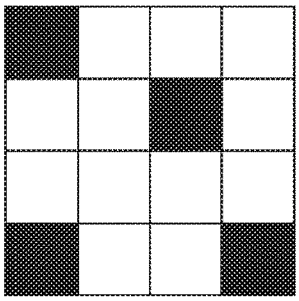
FIG. 17 is a diagram illustrating an example of a relationship between a value of N-value information and a value of M-value information.
Figure 17:
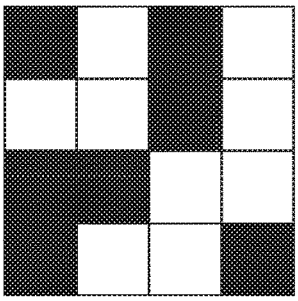
Figure 17:
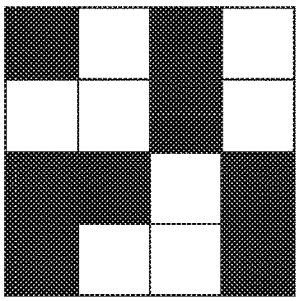
Figure 17:
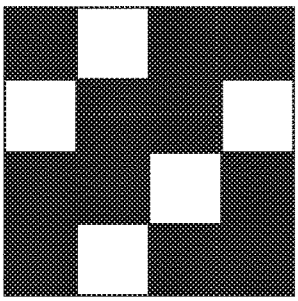
Figure 17:
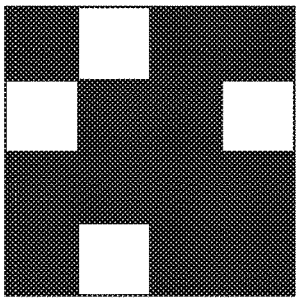
Figure 17:
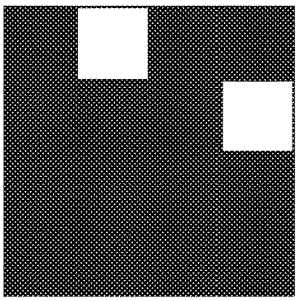
Figure 17:
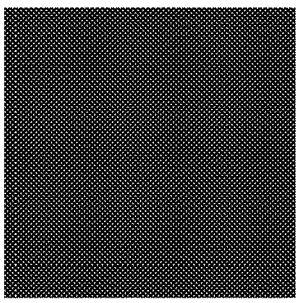
Figure 17:
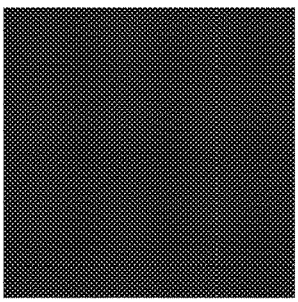

FIG. 17 is a diagram for explaining a dither pattern used in the quantization processing ST3 in the present embodiment. On the left side of FIG. 17, the relationship between the dither pattern relating to the quantization processing ST3 in the first nozzle group GN1, the N-value data Sin3, and the M-value data Sout3 is illustrated. Further, on the right side of FIG. 17, the relationship between the dither pattern relating to the quantization processing ST3 in the second nozzle group GN2, the N-value data Sin3, and the M-value data Sout3 is illustrated. Note that, although a dither matrix subdivided by 4×4 is illustrated in FIG. 17, the pattern of the dither matrix is not limited to this.

As can be seen from FIG. 17, the dither pattern applied to the second nozzle group GN2 has a larger number of pixels with lower threshold values than the dither pattern applied to the first nozzle group GN1. Therefore, as illustrated in FIG. 17, even when the same N-value data Sin3 is input, the M-value data Sout3 generated in the second nozzle group GN2 is larger than the M-value data Sout3 generated in the first nozzle group GN1. In other words, in the second nozzle group GN2, the number of pixels indicating ink discharge by the M-value data Sout3 becomes larger than in the first nozzle group GN1. Therefore, it is possible to reduce the discharge amount difference between the first nozzle group GN1 and the second nozzle group GN2 indicated by the discharge amount distribution J of FIG. 7.

4. Fourth Embodiment

In the present embodiment, the discharge amount difference indicated by the discharge amount distribution J is reduced by differentiating the color conversion processing between the N-value data which corresponds to the first nozzle group GN1 and the first color space data which corresponds to the second nozzle group GN2.

FIG. 18 is a diagram for explaining the color conversion LUT used in the color conversion processing ST1 in the present embodiment.

As can be seen from FIG. 18, in the color conversion LUT applied to the second nozzle group GN2, the value of the second color space data Sout1 is designed so as to be larger than the value in the color conversion LUT applied to the first nozzle group GN1. Therefore, even when the same first color space data Sin1 is input, the second color space data Sout1 generated in the second nozzle group GN2 is larger than the second color space data Sout1 generated in the first nozzle group GN1. Therefore, it is possible to reduce the discharge amount difference between the first nozzle group GN1 and the second nozzle group GN2 indicated by the discharge amount distribution J of FIG. 7.

5. Modification

The embodiment illustrated above may be variously modified. A specific form of modification that can be applied to the above-described embodiment is illustrated below. Two or more forms optionally selected from the following examples can be appropriately combined within a range not inconsistent with each other.

(1) In the above-described embodiment, the number of circulation heads Hn included in one head unit 252 is four, but the number of circulation heads Hn included in one head unit 252 may be three or less or five or more.

Figure 19:
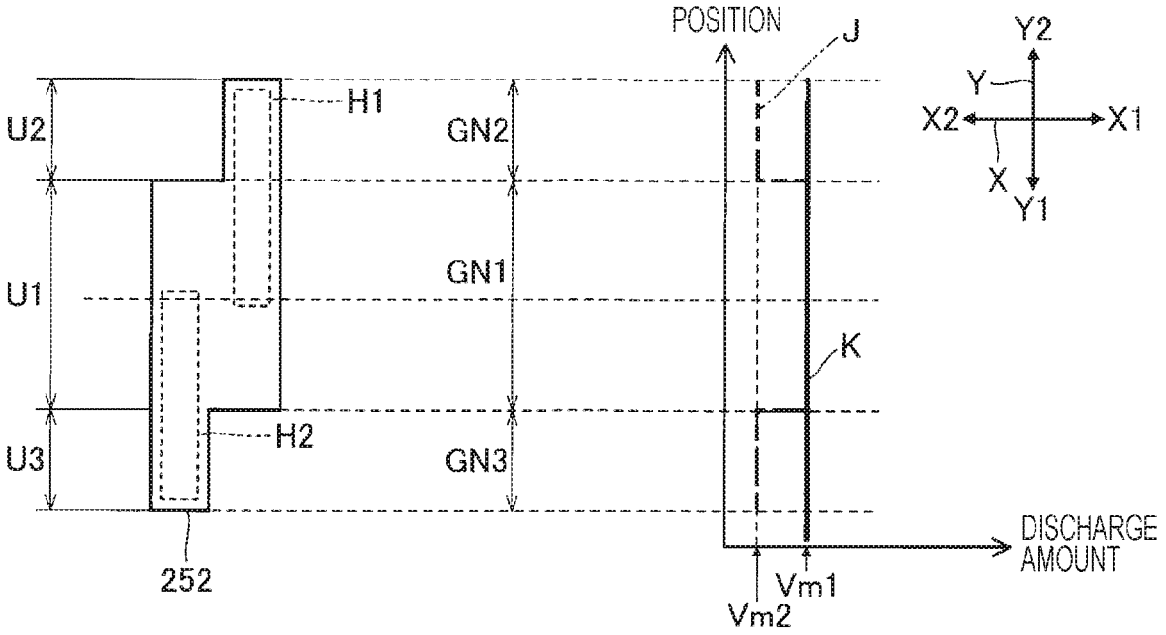
FIG. 19 is a diagram illustrating a configuration in which a head unit includes two heads.

FIG. 19 is a diagram illustrating a configuration in which the head unit 252 includes two circulation heads H1 and H2. As indicated by the discharge amount distribution J of FIG. 19, in the head unit 252, the discharge amount Vm1 from the nozzles N provided in the first portion U1 is larger than the discharge amount Vm2 from the nozzles N provided in the second portion U2 and the third portion U3.

Here, among the plurality of nozzles N included in the circulation heads H1 and H2, a set of the plurality of nozzles N positioned in the first portion U1 is a first nozzle group GN1. Among the plurality of nozzles N included in the circulation head H1, a set of the plurality of nozzles N positioned in the second portion U2 is a second nozzle group GN2. Among the plurality of nozzles N included in the circulation head H2, a set of the plurality of nozzles N positioned in the third portion U3 is a third nozzle group GN3.

Also in the head unit 252 illustrated in FIG. 19 described above, by performing the same processing as the above-described embodiment, it is possible to reduce the discharge amount difference between the first nozzle group GN1 and the second nozzle group GN2 or the third nozzle group GN3 caused by the temperature difference between the first portion U1 and the second portion U2.

(2) In the above-described embodiment, the plurality of head units 252 supported by the support body 251 have the same configuration as each other, but a part or all of the plurality of head units 252 may have different configurations.

(3) In the above-described embodiment, the sub tank 13 is provided outside the head unit 252 and ink is circulated between the head unit 252 and the sub tank 13. However, a system that circulates the ink between the head unit 252 and the outside of the head unit 252 may be used instead of the sub tank. For example, ink may be circulated between the head unit 252 and the liquid container 12.

(4) In the above-described embodiment, a serial type liquid discharge apparatus in which a transporting body 241 having a head unit 252 is reciprocated has been exemplified. However, the present disclosure can be applied to a line type liquid discharge apparatus in which a plurality of nozzles N are distributed over the entire width of the medium 11.

(5) The liquid discharge apparatus exemplified in the above-described embodiment can be adopted not only in a device dedicated to printing but also in various devices such as a facsimile machine and a copying machine. Note that, the application of the liquid discharge apparatus is not limited to printing. For example, a liquid discharge apparatus that discharges a solution of a coloring material is used as a manufacturing apparatus that forms a color filter of a display apparatus such as a liquid crystal display panel. In addition, a liquid discharge apparatus that discharges a solution of a conductive material is used as a manufacturing apparatus that forms wiring of a wiring substrate or electrodes. In addition, a liquid discharge apparatus that discharges a solution of an organic substance related to a living body is used, for example, as a manufacturing apparatus that manufactures a biochip.

(6) Although not illustrated, the circulation head Hn illustrated in the above-described embodiment is formed by stacking a plurality of substrates on which the above-described components of the circulation head Hn are appropriately provided. For example, a nozzle row La and a nozzle row Lb are provided on a nozzle substrate. A liquid storage chamber Ra and a liquid storage chamber Rb are provided on a reservoir substrate. A plurality of pressure chambers Ca and a plurality of pressure chambers Cb are provided on a pressure chamber substrate. A plurality of drive elements Ea and a plurality of drive elements Eb are provided on an element substrate. One or more of the above nozzle substrate, the reservoir substrate, the pressure chamber substrate, and the element substrate are individually provided for each circulation head Hn. For example, when the nozzle substrate is provided individually for each circulation head Hn, one or more of the reservoir substrate, the pressure chamber substrate, and the element substrate may be commonly provided for the plurality of circulation heads Hn in the head unit 252. Further, when the reservoir substrate and the pressure chamber substrate are individually provided for each circulation head Hn, the nozzle substrate or the like may be provided commonly for the plurality of circulation heads Hn in the head unit 252. Further, the drive circuits for driving the plurality of drive elements Ea and the plurality of drive elements Eb may be provided individually for each circulation head Hn, or may be provided commonly for the plurality of circulation heads Hn in the head unit 252.

What is claimed is:

1. A liquid discharge apparatus comprising:

a head unit in which a plurality of nozzles that discharge liquid are provided; and a control section that controls a discharge operation of the liquid in the head unit, wherein the head unit has a first portion, and a second portion which is different from the first portion in position in a first direction, and which has a width smaller than a width of the first portion in a second direction intersecting the first direction, the plurality of nozzles include a first nozzle group provided in the first portion, and a second nozzle group provided in the second portion, and the control section outputs a first output value as an output value which corresponds to the first nozzle group when a first input value is input as an input value which corresponds to the first nozzle group, and outputs a second output value as an output value which corresponds to the second nozzle group when the first input value is input as an input value which corresponds to the second nozzle group, the second output value being larger than the first output value.

2. The liquid discharge apparatus according to claim 1, wherein the control section outputs a third output value as the output value which corresponds to the first nozzle group when a second input value larger than the first input value is input as the input value which corresponds to the first nozzle group, and outputs the third output value as the output value which corresponds to the second nozzle group when the second input value is input as the input value which corresponds to the second nozzle group.

3. The liquid discharge apparatus according to claim 1, wherein the head unit further has a third portion which is different from the first portion in position in the first direction, and which has a width smaller than a width of the first portion in the second direction, and each of the plurality of nozzles is provided in any of the first portion, the second portion, and the third portion.

4. The liquid discharge apparatus according to claim 3, wherein the second portion is coupled to the first portion on a first side which is one side of the first direction, and the third portion is coupled to the first portion on a second side which is another side of the first direction.

5. The liquid discharge apparatus according to claim 3, wherein a position of an end surface of the second portion on a third side which is one side in the second direction and a position of an end surface of the first portion on the third side are identical in the second direction, and a position of an end surface of the third portion on a fourth side which is another side in the second direction and a position of an end surface of the first portion on the fourth side are identical in the second direction.

6. The liquid discharge apparatus according to claim 3, wherein the head unit has a first head in which a part of the plurality of nozzles is provided, and a part of which is positioned in the second portion and another part of which is positioned in the first portion, and a second head in which a part of the plurality of nozzles is provided, and a part of which is positioned in the third portion, and another part of which is positioned in the first portion.

7. The liquid discharge apparatus according to claim 6, wherein the head unit has a third head in which a part of the plurality of nozzles is provided, and which is positioned in the first portion, and a fourth head in which a part of the plurality of nozzles is provided, and which is different from the third head in position in the first direction and is positioned in the first portion.

8. The liquid discharge apparatus according to claim 6, wherein the head unit has a holder in which the first head and the second head are disposed.

9. The liquid discharge apparatus according to claim 8, wherein the head unit further has a fixing plate that fixes the first head and the second head to the holder.

10. The liquid discharge apparatus according to claim 6, wherein the first head and the second head have nozzle rows in which the parts of the plurality of nozzles are arranged in the first direction.

11. The liquid discharge apparatus according to claim 6, wherein the first nozzle group is provided in the second head, and the second nozzle group is provided in the first head.

12. The liquid discharge apparatus according to claim 1, wherein the head unit has a first energy generation element which generates energy for discharging liquid from the first nozzle group, a second energy generation element which generates energy for discharging liquid from the second nozzle group, and a pulse generation section that generates pulses for driving the first energy generation element and the second energy generation element, when the first input value is input to the control section as the input value which corresponds to each of the first nozzle group and the second nozzle group, the pulse supplied from the pulse generation section to the first energy generation element is a first pulse, and the pulse supplied from the pulse generation section to the second energy generation element is a second pulse, and a potential of the first pulse and a potential of the second pulse drop until a first timing, rise from a second timing after the first timing to a third timing after the second timing, and drop from a fourth timing after the third timing.

13. The liquid discharge apparatus according to claim 12, wherein the potential of the second pulse between the third timing and the fourth timing is higher than the potential of the first pulse between the third timing and the fourth timing.

14. The liquid discharge apparatus according to claim 12, wherein the potential of the second pulse between the first timing and the second timing is lower than the potential of the first pulse between the first timing and the second timing.

15. The liquid discharge apparatus according to claim 12, wherein a time length of the second pulse between the second timing and the third timing is smaller than a time length of the first pulse between the second timing and the third timing.

16. The liquid discharge apparatus according to claim 1, wherein the control section performs color conversion processing of converting first color space data which corresponds to a first color space including at least red, green, and blue into second color space data which corresponds to a second color space including at least cyan, magenta, and yellow, and when a value of the first color space data which corresponds to each of the first nozzle group and the second nozzle group is the first input value, a value of the second color space data which corresponds to the second nozzle group is larger than a value of the second color space data which corresponds to the first nozzle group.

17. The liquid discharge apparatus according to claim 1, wherein the control section performs correction processing of correcting pre-correction data which corresponds to a second color space including at least cyan, magenta, and yellow to generate post-correction data having a gradation value different from a gradation value of the pre-correction data at least in part, and when a value of the pre-correction data which corresponds to each of the first nozzle group and the second nozzle group is the first input value, a value of the post-correction data which corresponds to the second nozzle group is larger than a value of the post-correction data which corresponds to the first nozzle group.

18. The liquid discharge apparatus according to claim 1, wherein the control section performs quantization processing of quantizing N-value data which corresponds to a second color space including at least cyan, magenta, and yellow and indicates an N-value, N being an integer, to generate M-value data indicating an M-value, M being an integer smaller than N and larger than 1, and when a value of the N-value data which corresponds to each of the first nozzle group and the second nozzle group is the first input value, a value of the M-value data which corresponds to the second nozzle group is larger than a value of the M-value data which corresponds to the first nozzle group.

* * * * *